US010779651B2

(12) United States Patent
Bai

(10) Patent No.: US 10,779,651 B2
(45) Date of Patent: Sep. 22, 2020

(54) ASSEMBLY FOR ASSEMBLED CONTAINER HOUSE SYSTEM

(71) Applicant: QINGDAO CENTAURY DESIGN CO., LTD., Qingdao (CN)

(72) Inventor: Guifen Bai, Qingdao (CN)

(73) Assignee: QINGDAO CENTAURY DESIGN CO., LTD, Qingdao (CN)

( * ) Notice: Subject to any disclaimer, the term of this patent is extended or adjusted under 35 U.S.C. 154(b) by 0 days.

(21) Appl. No.: 16/338,444

(22) PCT Filed: Jun. 15, 2017

(86) PCT No.: PCT/CN2017/088479
§ 371 (c)(1),
(2) Date: Mar. 29, 2019

(87) PCT Pub. No.: WO2018/176638
PCT Pub. Date: Oct. 4, 2018

(65) Prior Publication Data

US 2019/0223597 A1 Jul. 25, 2019

(30) Foreign Application Priority Data

Mar. 27, 2017 (CN) ..... 2017 1 0187329

(51) Int. Cl.
*E04B 1/61* (2006.01)
*A47B 96/20* (2006.01)
(Continued)

(52) U.S. Cl.
CPC ..... *A47B 96/201* (2013.01); *E04B 1/34321* (2013.01); *E04B 1/6179* (2013.01);
(Continued)

(58) Field of Classification Search
CPC ..... A47B 96/201; A47B 2220/0052; A47B 2096/207; E04B 1/34321; E04B 7/06;
(Continued)

(56) References Cited

U.S. PATENT DOCUMENTS

2007/0094979 A1* 5/2007 Richardson ..... E04B 1/34321 52/578
2008/0282623 A1 11/2008 Powell
(Continued)

FOREIGN PATENT DOCUMENTS

CA 2 653 273 A1 8/2009
CN 2561838 Y 7/2003
(Continued)

OTHER PUBLICATIONS

The International Search Report of corresponding International Application No. PCT/CN2017/088479, dated Jan. 2, 2018.

*Primary Examiner* — Patrick J Maestri
(74) *Attorney, Agent, or Firm* — J.C. Patents

(57) ABSTRACT

The present invention relates to an assembly for an assembled container house system. The assembly includes: a first main wallboard, where the first main wallboard has a rectangular body; an upper right portion of the body of the first main wallboard protrudes rightwards to form a spherical protrusion, and a lower right portion extends rightwards to form an extension portion; an upper left portion of the body of the first main wallboard extends leftwards to form an extension portion, and a lower let portion protrudes leftwards to form a spherical protrusion; spherical recessed cavities are formed on front end surfaces of the two extension portions by means of being recessed backwards; the spherical protrusions match the spherical recessed cavities; and an axial direction of the spherical protrusion is perpendicular to an axial direction of the spherical recessed cavity. The assembly for an assembled container house system may
(Continued)

be assembled into members with different lengths, different heights, different widths, and different colors, such as a house, a large shed, a cabinet, and a box, as well as toys. Moreover, independently used bathrooms, living rooms, and washbasin systems may be derived. Various components are reliably connected, may be repeatedly used, are suitable for industrial standardized and mass production, and facilitate transportation and splicing.

10 Claims, 32 Drawing Sheets

(51) Int. Cl.

| | |
|---|---|
| ***E04B 7/02*** | (2006.01) |
| ***E04B 7/06*** | (2006.01) |
| ***E04C 2/20*** | (2006.01) |
| ***E04C 2/30*** | (2006.01) |
| ***E06B 1/52*** | (2006.01) |
| ***E06B 1/70*** | (2006.01) |
| ***E06B 3/36*** | (2006.01) |
| ***E04C 2/52*** | (2006.01) |
| ***E04B 1/343*** | (2006.01) |
| *E04C 2/00* | (2006.01) |

(52) U.S. Cl.
CPC ..... *E04B 7/026* (2013.01); *E04B 7/06* (2013.01); *E04C 2/20* (2013.01); *E04C 2/30* (2013.01); *E04C 2/526* (2013.01); *E06B 1/52* (2013.01); *E06B 1/70* (2013.01); *E06B 3/367* (2013.01); *A47B 2096/207* (2013.01); *A47B 2220/0052* (2013.01); *E04B 2001/6195* (2013.01); *E04C 2002/004* (2013.01)

(58) Field of Classification Search
CPC ..... E04B 7/026; E04B 1/6179; E04B 2001/6195; E04B 1/34384; E04C 2/526; E04C 2/30; E04C 2/20; E04C 2002/004; E06B 3/367; E06B 1/70; E06B 1/52
See application file for complete search history.

(56) References Cited

U.S. PATENT DOCUMENTS

| | | | | |
|---|---|---|---|---|
| 2011/0247285 | A1* | 10/2011 | Wybo | B29C 48/908 52/309.1 |
| 2011/0258943 | A1* | 10/2011 | De Zen | E04B 1/34321 52/43 |
| 2012/0117903 | A1* | 5/2012 | Wedi | E04C 2/288 52/309.4 |
| 2013/0000218 | A1* | 1/2013 | Uffner | E04B 1/34321 52/79.1 |
| 2013/0112356 | A1* | 5/2013 | Matthews | E04C 2/20 160/229.1 |
| 2019/0142459 | A1* | 5/2019 | Zhu | A61B 17/3439 604/167.01 |
| 2019/0340326 | A1* | 11/2019 | Huda | G06F 30/398 |

FOREIGN PATENT DOCUMENTS

| | | | |
|---|---|---|---|
| CN | 201826393 | U | 5/2011 |
| CN | 202176123 | U | 3/2012 |
| CN | 103015765 | A | 4/2013 |
| CN | 203270835 | U | 11/2013 |
| CN | 106284672 | A | 1/2017 |
| CN | 206646652 | U | 11/2017 |
| KR | 2014-0052187 | A | 5/2014 |

* cited by examiner

ASSEMBLY FOR ASSEMBLED CONTAINER HOUSE SYSTEM

CROSS-REFERENCE TO RELATED APPLICATION

This application is a national phase application of international application No. PCT/CN2017/088479 filed on Jun. 15, 2017, which in turn claims the priority benefits of Chinese application No. 201710187329.7, filed on Mar. 27, 2017. The contents of these prior applications are hereby incorporated by reference in their entirety.

BACKGROUND

Technical Field

The present invention relates to the technical field of gardening furniture, and particularly to an assembly for an assembled container house system.

Related Art

Most of the existing houses that can be assembled on site in the domestic and foreign markets have excessively large sizes, and need to be supported by metal columns and beams and fixed by a large amount of hardware. Consequently, it is inconvenient to install, purchase, and transport the houses. Moreover, the windbreaking performances are not good, and the houses cannot be repeatedly assembled and disassembled. Moreover, there is no associated member between components such as a cabinet, a case, a box, and a room. Flexibility and manufacturing and purchasing costs of the product are difficult to control. The houses are installed by using large-size members and a large quantity of rivets, and basically cannot be repeatedly assembled and disassembled.

SUMMARY

The present invention aims to resolve the foregoing problems, and provides an assembly for an assembled container house system, which may be assembled into members with different lengths, different heights, different widths, and different colors, such as a house, a large shed, a cabinet, and a box, as well as toys. Moreover, independently used bathrooms, living rooms, and washbasin systems may be derived. Various components are reliably connected, may be repeatedly used, are suitable for industrial standardized and mass production, and facilitate transportation and splicing. The following technical solutions are used.

An assembly for an assembled container house system is provided, including: a first main wallboard, where the first main wallboard has a rectangular body; an upper right portion of the body of the first main wallboard protrudes rightwards to form a spherical protrusion, and a lower right portion extends rightwards to form an extension portion; an upper left portion of the body of the first main wallboard extends leftwards to form an extension portion, and a lower left portion protrudes leftwards to form a spherical protrusion; spherical recessed cavities are formed on front end surfaces of the two extension portions by means of being recessed backwards; the spherical protrusions match the spherical recessed cavities; and an axial direction of the spherical protrusion is perpendicular to an axial direction of the spherical recessed cavity.

Based on the foregoing technical solution, the assembly for an assembled container house system further includes a second main wallboard and a semi-main wallboard, where the second main wallboard has a rectangular body; a lower right portion of the body of the second main wallboard protrudes rightwards to form a spherical protrusion, and an upper right portion extends rightwards to form an extension portion; a lower left portion of the body of the second main wallboard extends leftwards to form an extension portion, and an upper left portion protrudes leftwards to form a spherical protrusion; spherical recessed cavities are formed on front end surfaces of the two extension portions by means of being recessed backwards; the spherical protrusions match the spherical recessed cavities; an axial direction of the spherical protrusion is perpendicular to an axial direction of the spherical recessed cavity; the length of the semi-main wallboard is equal to the length of the second main wallboard; the height of the first main wallboard is the same as the height of the second main wallboard; the height of the semi-main wallboard is a half of the height of the first main wallboard; a right side of the semi-main wallboard protrudes to form a spherical protrusion having an axis parallel to a front end surface of the semi-main wallboard, and a left side protrudes to form an extension portion having the spherical recessed cavity; and an axis of the spherical recessed cavity is perpendicular to the front end surface of the semi-main wallboard.

Based on the foregoing technical solution, top portions of the first main wallboard and the second main wallboard protrude upwards to form column pins; bottom portions of the first main wallboard and the second main wallboard are recessed upwards to form holes matching the column pins; and a top portion of the semi-main wallboard protrudes upwards to form column pins, and a bottom portion is recessed upwards to form holes matching the column pins.

Based on the foregoing technical solution, the assembly for an assembled container house system further includes an auxiliary wallboard, a semi-auxiliary wallboard, and a horizontal connector capable of butt-jointing wallboards horizontally, where the structure of the auxiliary wallboard is the same as the structure of the first main wallboard, and the body length of the auxiliary wallboard is a half of the body length of the first main wallboard, or the structure of the auxiliary wallboard is the same as the structure of the second main wallboard, and the body length of the auxiliary wallboard is a half of the body length of the first main wallboard; the height of the auxiliary wallboard is the same as the height of the first main wallboard and the height of the second main wallboard; the height of the semi-auxiliary wallboard is a half of the height of the auxiliary wallboard, and the length of the semi-auxiliary wallboard is the same as the length of the auxiliary wallboard; and the structure of the semi-auxiliary wallboard is the same as the structure of an upper half portion of the auxiliary wallboard.

Based on the foregoing technical solution, the horizontal connector is integrally formed by a first stopper, a second stopper, and a third stopper; the third stopper is located between the first stopper and the second stopper; a spherical protrusion matching the spherical recessed cavity is formed on the first stopper in a protruding manner; a spherical recessed cavity matching the spherical protrusion is formed on the third stopper in a recessed manner; an axial direction of the spherical protrusion on the horizontal connector is perpendicular to an axial direction of the spherical recessed cavity on the horizontal connector; and the spherical protrusion and the spherical recessed cavity are located on different sides of the third stopper.

Based on the foregoing technical solution, the extension portion is semicircular; and a clamping portion that faces the spherical recessed cavity on the horizontal connector and extends along an arc-shaped surface of the extension portion is formed on a surface, away from the spherical protrusion, of the third stopper.

Based on the foregoing technical solution, the assembly for an assembled container house system further includes a door opening hole wallboard, where the structure of the door opening hole wallboard is the same as the structure of the first main wallboard or the second main wallboard; and the door opening hole wallboard is provided with a door hole.

Based on the foregoing technical solution, both the first main wallboard and the second main wallboard have a thick bottom portion and a thin top portion.

Based on the foregoing technical solution, bottom surfaces of the first main wallboard and the second main wallboard protrude downwards to form an elongated step extending along a length direction of a wallboard, where the thickness of the step is smaller than the thicknesses of the bottom surfaces of the first main wallboard and the second main wallboard; and top surfaces of the first main wallboard and the second main wallboard are recessed downwards to form a recess extending along a length direction of a wallboard, where the thickness of the step is greater than the thickness of the recess.

Based on the foregoing technical solution, the assembly for an assembled container house system further includes a roof, where the roof includes two main roofs and a daylighting, rainproof, and ventilating skylight; the two main roofs may be assembled with each other; and the daylighting, rainproof, and ventilating skylight is located between the two main roofs.

Based on the foregoing technical solution, the roof further includes at least one auxiliary roof; the auxiliary roof is assembled between the two main roofs; and the daylighting, rainproof, and ventilating skylight is assembled between the main roofs and the auxiliary roof and between adjacent auxiliary roofs.

Based on the foregoing technical solution, the assembly for an assembled container house system further includes an upper cover, where the upper cover is in one of following two forms:

form 1), the upper cover is an integral board;

form 2), the upper cover is formed by a first folded plate and a second folded plate, where the first folded plate is hingedly connected to the second folded plate.

Based on the foregoing technical solution, the assembly for an assembled container house system further includes a hook, where the hook is provided with a through hole capable of being sleeved on a column pin.

Based on the foregoing technical solution, the assembly for an assembled container house system further includes a door plate, a threshold, a door beam, a first corner doorframe, and a second corner doorframe, where the door plate has a rotation portion hingedly connected to a wallboard; the threshold is recessed; a spherical protrusion is formed on a right side surface of the threshold by means of protruding rightwards; a left side of the threshold protrudes to form a second extension portion of which a rear end surface has a spherical recessed cavity; an axis of the spherical protrusion on the threshold is perpendicular to an axis of the spherical recessed cavity on the threshold; the door beam is T-shaped; a spherical protrusion is formed on a left side surface of the door beam by means of protruding leftwards; a right side of the door beam protrudes to form a second extension portion of which a rear end surface has a spherical recessed cavity; an axis of the spherical protrusion on the door beam is perpendicular to an axis of the spherical recessed cavity on the door beam; a second extension portion of which a rear end surface has a spherical recessed cavity is integrally formed on a bottom half portion of a right side of the first corner doorframe; a spherical protrusion is formed on a top half portion of the right side of the first corner doorframe by means of protruding rightwards; an axis of the spherical protrusion on the first corner doorframe is perpendicular to an axis of the spherical recessed cavity on the first corner doorframe; a second extension portion of which a rear end surface has a spherical recessed cavity is integrally formed on a top half portion of a right side of the second corner doorframe; a spherical protrusion is formed on a bottom half portion of the right side of the second corner doorframe by means of protruding rightwards; and an axis of the spherical protrusion on the second corner doorframe is perpendicular to an axis of the spherical recessed cavity on the second corner doorframe.

Based on the foregoing technical solution, the second corner doorframe is provided with a shaft hole configured to install a shaft of a door plate.

Based on the foregoing technical solution, the first corner doorframe is provided with a lock hole configured to install a padlock.

Based on the foregoing technical solution, the second corner doorframe is slidably connected to a sliding block configured to connect a sliding door rope.

Based on the foregoing technical solution, the assembly for an assembled container house system further includes a roof ridge, where the roof ridge is formed by a primary beam, an elastic body, and an integral board that is installed on two sides of the primary beam in a matching manner; the primary beam is formed by sequentially splicing a plurality of primary beam members from left to right; a left splicing portion of the primary beam member matches a right splicing portion of the primary beam member; the left splicing portion and the right splicing portion are provided with a spherical protrusion and a spherical recessed cavity matching each other; an upper end surface of the primary beam member is provided with a first hook-like structure and a second hook-like structure that are distributed in a staggered manner and are opposite to each other; the elastic body is T-shaped; an inner end of the integral board is located between the first hook-like structure and the second hook-like structure that are opposite to each other and is located between an arm of the elastic body and a top surface of the primary beam member.

Based on the foregoing technical solution, the arm of the elastic body is an arc-shaped rainproof arm extending downwards from the center to both sides.

Based on the foregoing technical solution, axes of the spherical protrusions and the spherical recessed cavities on the left splicing portion and the right splicing portion are parallel to the top surface of the primary beam member.

The present invention has the following advantages: the assembly for an assembled container house system may be assembled into members with different lengths, different heights, different widths, and different colors, such as a house, a large shed, a cabinet, and a box, as well as toys. Moreover, independently used bathrooms, living rooms, and washbasin systems may be derived. Various components are reliably connected, may be repeatedly used, are suitable for industrial standardized and mass production, and facilitate transportation and splicing.

BRIEF DESCRIPTION OF THE DRAWINGS

To describe the technical solutions in the embodiments of the present invention or in the prior art more clearly, the following briefly describes the accompanying drawings required for describing the embodiments or the prior art. Apparently, the accompanying drawings in the following description show merely one embodiment of the present invention, and a person of ordinary skill in the art may still derive other accompanying drawings of implementation from the provided accompanying drawings without creative efforts.

DETAILED DESCRIPTION

The present invention is further described below with reference to the accompanying drawings and the embodiments.

Embodiments of the present invention are described in detail below. Examples of the embodiments are shown in the accompanying drawings, where same or similar numbers represent same or similar elements or elements having same or similar functions throughout. The embodiments described below with reference to the accompanying drawings are exemplary, are merely intended to explain the present invention, but cannot be understood as a limitation to the present invention.

In the description of the present invention, it should be noted that unless otherwise stipulated and defined, terms "install", "connected" and "connection" should be understood in a broad sense, for example, the connection may be a fixed connection, a detachable connection, or an integral connection; the connection may be a direct connection, or an indirect connection via an intermediate. A person of ordinary skill in the art may understand specific meanings of the foregoing terms in the present invention according to specific conditions.

In the description of the present invention, it should be noted that terms "first" and "second" are merely intended for description, and cannot be understood to indicate or imply relative importance.

Embodiment 1

Figure 1:
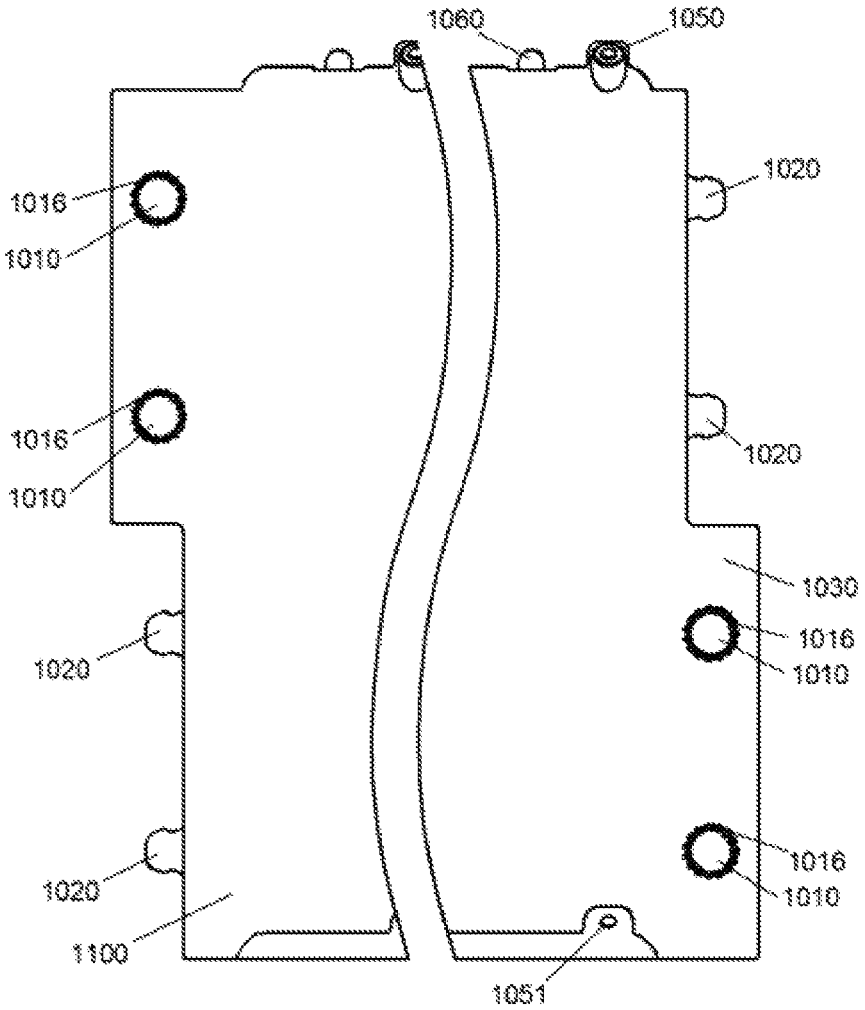
FIG. 1 is a schematic structural diagram of a first main wallboard according to the present invention.
Figure 2:
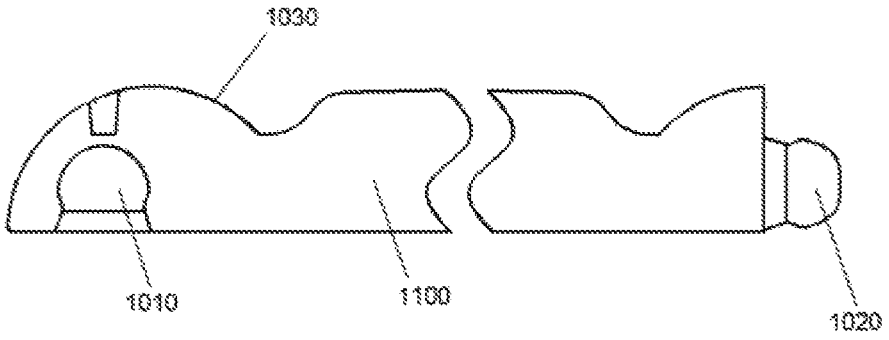
FIG. 2 is a schematic structural sectional view of the first main wallboard according to the present invention.

As shown in FIG. 1 and FIG. 2, it should be noted herein that the nouns of locality, i.e., left and right in Embodiment 1 are defined with reference to the view shown in FIG. 1. It should be understood that use of the nouns of locality should not limit the protection scope of this application. An assembly for an assembled container house system in this embodiment includes: a first main wallboard 1100, where the first main wallboard 1100 has a rectangular body; an upper right portion of the body of the first main wallboard 1100 protrudes rightwards to form a spherical protrusion 1020, and a lower right portion extends rightwards to form an extension portion 1030; an upper left portion of the body of the first main wallboard 1100 extends leftwards to form an extension portion 1030, and a lower left portion protrudes leftwards to form a spherical protrusion 1020; spherical recessed cavities 1010 are formed on front end surfaces of the two extension portions 1030 by means of being recessed backwards and the spherical protrusions 1020 match the spherical recessed cavities 1010. Herein, it should be noted that a match indicates that, with respect to two first main wallboards 1100, a spherical protrusion 1020 of one first main wallboard 1100 may be inserted into a spherical recessed cavity 1010 of the other first main wallboard 1100, and would not disengage from it easily. An axial direction of the spherical protrusion 1020 is perpendicular to an axial direction of the spherical recessed cavity 1010.

Figure 3:
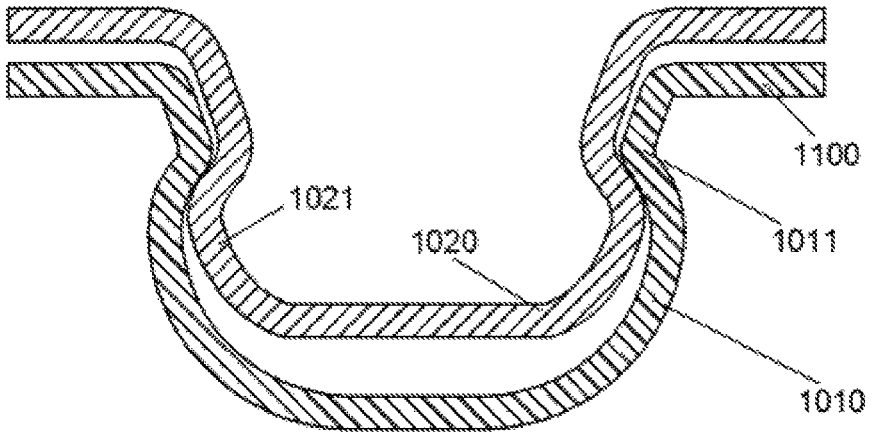
FIG. 3 is a schematic structural sectional view after a spherical recessed cavity matches a spherical protrusion according to the present invention.

As shown in FIG. 3, preferably, the spherical recessed cavity 1010 has a narrow portion 1011. The spherical protrusion 1020 has a head portion 1021 having an outer diameter greater than an inner diameter of the narrow portion 1011. Upon forced impact by an external force, the head portion 1021 of the spherical protrusion 1020 may deform to be embedded into the spherical recessed cavity 1010, and is limited by the narrow portion 1011, so that the head portion 1021 is prevented from disengaging from the spherical recessed cavity 1010.

Preferably, both the spherical recessed cavity 1010 and the spherical protrusion 1020 are integrally formed by means of single-layer and seamless blow molding, so that a relatively good deformation space for expansion and shrinkage may be obtained.

Figure 4:
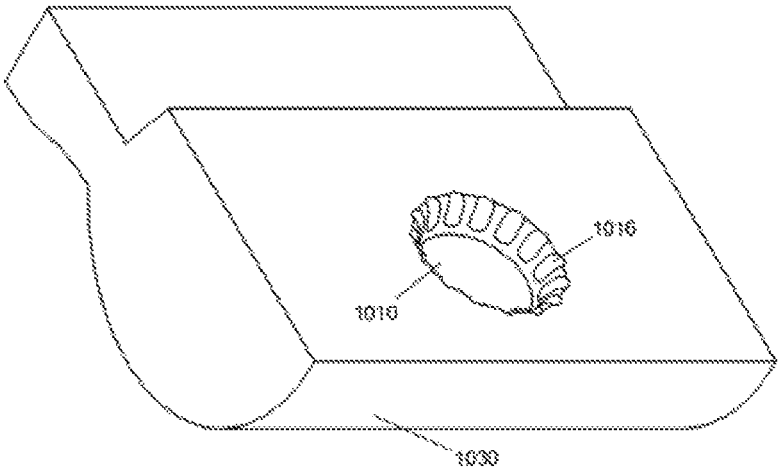
FIG. 4 is a stereoscopic schematic structural diagram of the spherical recessed cavity according to the present invention.

As shown in FIG. 4, preferably, a discontinuous concave-convex structure 1016 is formed on an inner surface of the spherical recessed cavity 1010, thereby improving structural rigidity.

Figure 5:
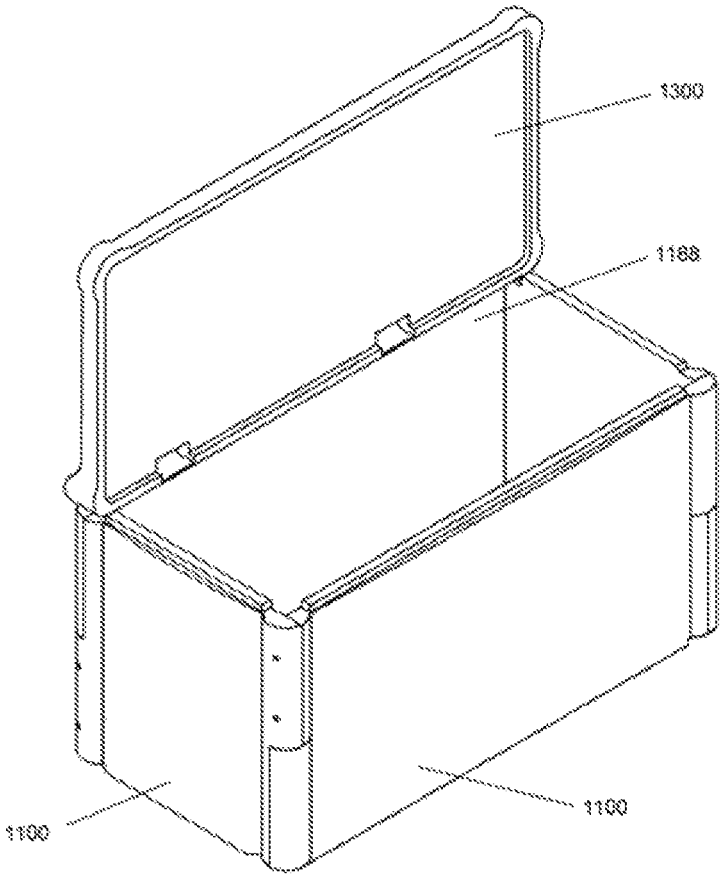
FIG. 5 is a stereoscopic schematic structural diagram of a base cabinet according to Embodiment 1.

As shown in FIG. 5, an assembled container house system is provided, where the assembled container house system is formed by sequentially and vertically splicing four first main wallboards 1100. It may be understood that multiple sizes may be set for the first main wallboards 1100 according to the requirements. That is, structures of the main wallboards 1100 are the same but the sizes may be different.

As shown in FIG. 2, axes of the spherical protrusions 1020 of adjacent first main wallboards 1100 are perpendicular to each other. Therefore, each first main wallboard 1100 is restricted by two directions that are perpendicular to each other. Hence, a self-locking structure may be formed between the first main wallboards 1100, to achieve higher stability.

The assembled container house system may further include an upper cover, where the upper cover is an integral board 1300. One first main wallboard 1100 may be a wallboard 1188 having a shaft. One side of the integral board 1300 is rotatably connected to the shaft of the wallboard 1188 having a shaft, so that the integral board 1300 may open or close a top surface of the square assembled container house system. The assembled container house system having an upper cover may be used as a base cabinet in which objects may be placed, and the upper cover may serve as a bench after being laid down.

Embodiment 2

As shown in FIG. 1, it should be noted herein that the nouns of locality, i.e., left and right for describing the first main wallboard are both defined with reference to the view shown in FIG. 1. It should be understood that use of the nouns of locality should not limit the protection scope of this application. An assembly for an assembled container house system includes: a first main wallboard 1100, where the first main wallboard 1100 has a rectangular body; an upper right portion of the body of the first main wallboard 1100 protrudes rightwards to form a spherical protrusion 1020, and a lower right portion extends rightwards to form an extension portion 1030; an upper left portion of the body of the first main wallboard 1100 extends leftwards to form an extension portion 1030, and a lower left portion protrudes leftwards to form a spherical protrusion 1020; spherical recessed cavities 1010 are formed on front end surfaces of the two extension portions 1030 by means of being recessed backwards; the spherical protrusions 1020 match the spherical recessed cavities 1010; and an axial direction of the spherical protrusion 1020 is perpendicular to an axial direction of the spherical recessed cavity 1010.

Figure 6:
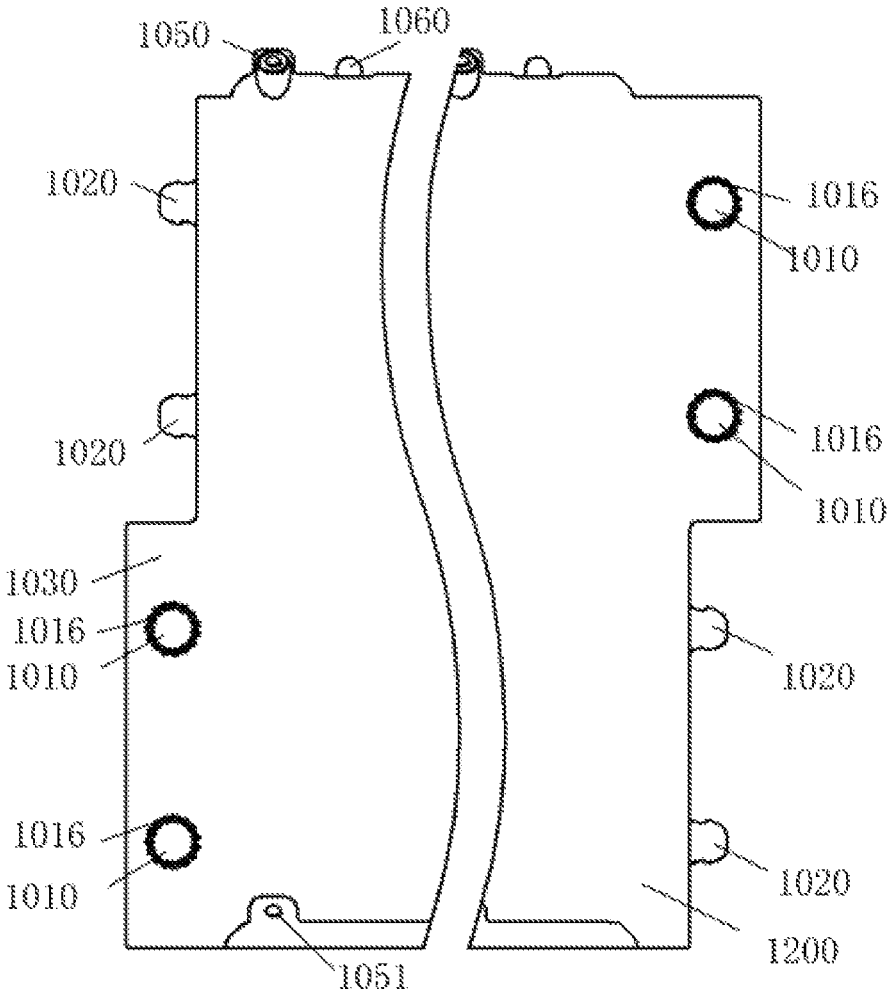
FIG. 6 is a schematic structural diagram of a second main wallboard according to the present invention.
Figure 7:
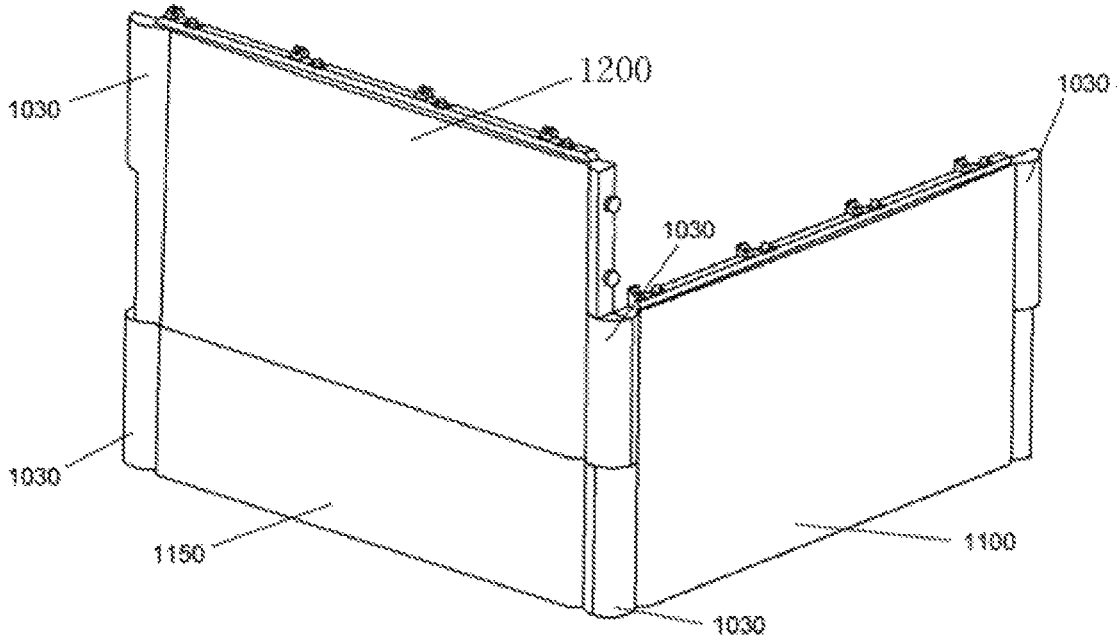
FIG. 7 is a schematic structural diagram of a cabinet body according to Embodiment 2.

As shown in FIG. 7, it should be noted herein that the nouns of locality, i.e., left and right in Embodiment 2 for describing the second main wallboard are defined with reference to the view shown in FIG. 6. It should be understood that use of the nouns of locality should not limit the protection scope of this application. To form a higher diversified container house system, the assembly for an assembled container house system further includes a second main wallboard 1200 and a semi-main wallboard 1150. The second main wallboard 1200 has a rectangular body, where a lower right portion of the body of the second main wallboard 1200 protrudes rightwards to form a spherical protrusion 1020, and an upper right portion extends rightwards to form an extension portion 1030; a lower left portion of the body of the second main wallboard 1200 extends leftwards to form an extension portion 1030, and an upper left portion protrudes leftwards to form a spherical protrusion 1020. Spherical recessed cavities 1010 are formed on front end surfaces of the two extension portions 1030 by means of being recessed backwards. The spherical protrusions 1020 match the spherical recessed cavities 1010. An axial direction of the spherical protrusion 1020 is perpendicular to an axial direction of the spherical recessed cavity 1010. That is, the structure (shape) of the second main wallboard 1200 is in mirror symmetry to the structure (shape) of the first main wallboard 1100. However, the size of the second main wallboard 1200 may be the same as the size of the first main wallboard 1100, or may be different from the size of the first main wallboard 1100. Because there is a plurality of second main wallboards 1200, these second main wallboards 1200 have the same shape, but may have the same or different sizes, and this is set according to the actual requirements, and also applies to the first main wallboard 1100. The length of the semi-main wallboard 1150 is equal to the length of the second main wallboard 1200. It should be noted herein that "length" refers to a distance from left to right with reference to FIG. 6. The height of the first main wallboard 1100 is the same as the height of the second main wallboard 1200. The height of the semi-main wallboard 1150 is a half of the height of the first main wallboard 1100. It should be noted herein that "height" refers to a distance from top to bottom with reference to FIG. 6. A right side of the semi-main wallboard 1150 protrudes to form a spherical protrusion 1020 having an axis parallel to a front end surface of the semi-main wallboard 1150, and a left side protrudes to form an extension portion 1030 having the spherical recessed cavity 1010, where an axis of the spherical recessed cavity 1010 is perpendicular to the front end surface of the semi-main wallboard 1150. That is, all first main wallboards 1100 and all second main wallboards 1200 are preferably consistent in height, thereby facilitating splicing, but all the first main wallboards 1100 and all the second main wallboards 1200 may be the same or different in length.

It may be understood that the first main wallboard 1100 and the second main wallboard 1200 be replaced by each other (equivalence to some degree). That is, a new first main wallboard 1100 may also have the structure of an original second main wallboard 1200. However, at the same time, the structure of a new second main wallboard 1200 is replaced with the structure of an original first main wallboard 1100.

As an implementation, while being used, as shown in FIG. 7, if a square cabinet structure needs to be assembled, description is first made by using how to form two adjacent perpendicular planes of the square structure as an example.

First, the spherical protrusion 1020 on the right side of the semi-main wallboard 1150 is connected to the extension portion 1030 on the left side of the first main wallboard 1100. Subsequently, the second main wallboard 1200 is placed on the semi-main wallboard 1150, so that the extension portion 1030 on the right side of the main wallboard 1200 is connected to the spherical protrusion 1020 on the left side of the first main wallboard 1100. A layer of first main wallboard 1100 is further placed above the first main wallboard 1100, so that the extension portion 1030 on the left side of the first main wallboard 1100 is connected to the spherical protrusion 1020 on the right side of the second main wallboard 1200. A layer of second main wallboard 1200 is further placed above the second main wallboard 1200, so that the extension portion 1030 on the right side of the second main wallboard 1200 is connected to the spherical protrusion 1020 on the left side of the upper layer of first main wallboard 1100, and so on, so that the height may be continuously increased. The first main wallboards 1100 and the second main wallboards 1200 are alternately spliced to increase the height. Other two planes are the same as the two adjacent perpendicular planes, that is, the structures of opposite planes are the same.

To enable the connection between upper and lower wallboards to be more firm, preferably, top portions of the first main wallboard 1100 and the second main wallboard 1200 protrude upwards to form column pins 1060. Bottom portions of the first main wallboard 1100 and the second main wallboard 1200 are recessed upwards to form holes matching the column pins 1060. A top portion of the semi-main wallboard 1150 protrudes upwards to form column pins 1060, and a bottom portion is recessed upwards to form holes matching the column pins 1060. In this way, column pins of a lower wallboard may be inserted into holes of an upper wallboard. Therefore, stability of the spliced structure is enhanced.

Embodiment 3

Figure 8:
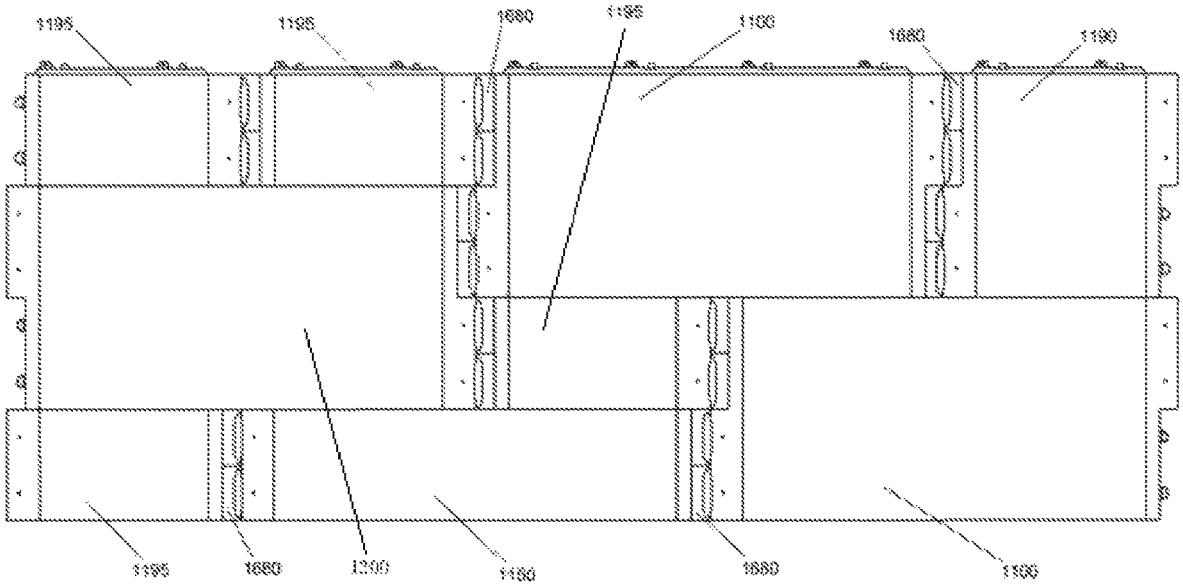
FIG. 8 is a schematic structural diagram of an assembly plate of a container house system according to Embodiment 3.

As shown in FIG. 8, based on the assembly in Embodiment 2, to form a larger diversified container house system, the assembly for an assembled container house system may further include an auxiliary wallboard 1190, a semi-auxiliary wallboard 1195, and a horizontal connector 1680 capable of butt-jointing various wallboards horizontally. The structure of the auxiliary wallboard 1190 is the same as the structure of the first main wallboard 1100, and the body length of the auxiliary wallboard 1190 is a half of the body length of the first main wallboard 1100. Alternatively, the structure of the auxiliary wallboard 1190 is the same as the structure of the second main wallboard 1200, and the body length of the auxiliary wallboard 1190 is a half of the body length of the first main wallboard 1100. The height of the auxiliary wallboard 1190 is the same as the height of the first main wallboard 1100 and the height of the second main wallboard 1200. The height of the semi-auxiliary wallboard 1195 is a half of the height of the auxiliary wallboard 1190, and the length of the semi-auxiliary wallboard 1195 is the same as the length of the auxiliary wallboard 1190. The structure of the semi-auxiliary wallboard 1195 is the same as the structure of an upper half portion of the auxiliary wallboard 1190. The horizontal connector 1680 may splice various wallboards (the auxiliary wallboard 1190, the semi-auxiliary wallboard 1195, the first main wallboard 1100, the second main wallboard 1200, and the semi-main wallboard 1150) horizontally.

Figure 9:
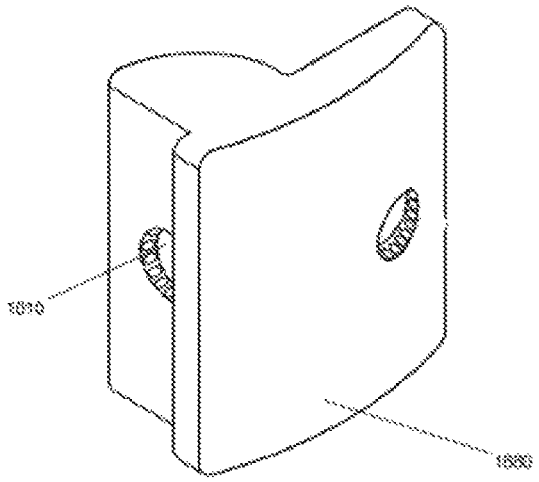
FIG. 9 is a stereoscopic schematic structural diagram from a front viewing angle of a horizontal connector according to the present invention.
Figure 10:
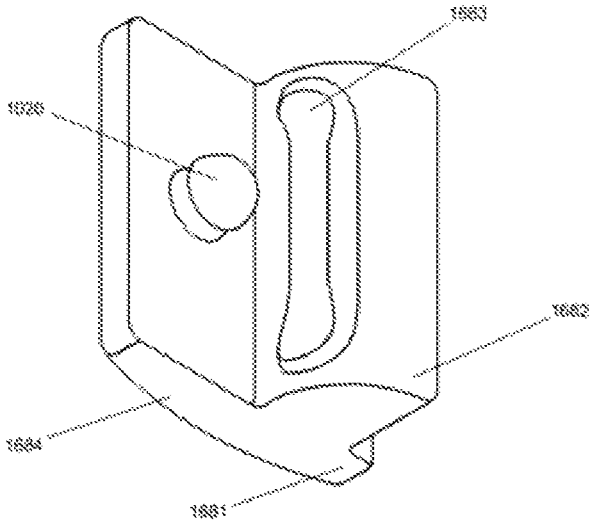
FIG. 10 is a stereoscopic schematic structural diagram from a back viewing angle of the horizontal connector according to the present invention.
Figure 11:
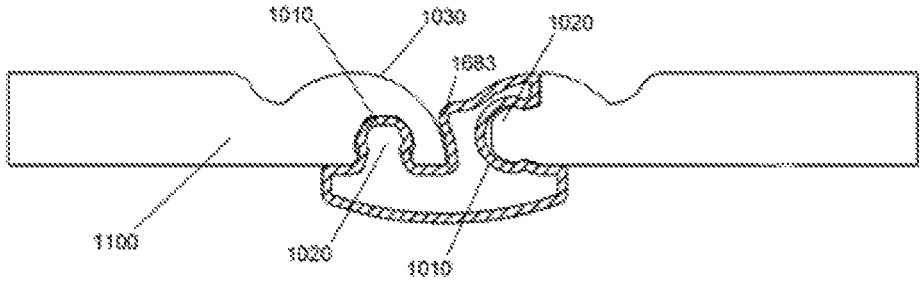
FIG. 11 is a schematic structural sectional view showing that a wallboard performs a horizontal connection by using the horizontal connector.

As shown in FIG. 9 to FIG. 11, further, the horizontal connector 1680 is integrally formed by a first stopper 1684, a second stopper 1681, and a third stopper 1682. The third stopper 1682 is located between the first stopper 1684 and the second stopper 1681. A spherical protrusion 1020 matching the spherical recessed cavity 1010 is formed on the first stopper 1684 in a protruding manner. A spherical recessed cavity 1010 matching the spherical protrusion 1020 is formed on the third stopper 1682 in a recessed manner. An axial direction of the spherical protrusion 1020 on the horizontal connector 1680 is perpendicular to an axial direction of the spherical recessed cavity 1010 on the horizontal connector 1680. The spherical protrusion 1020 and the spherical recessed cavity 1010 are located on different sides of the third stopper 1682.

As shown in FIG. 11, further, the extension portion 1030 is semicircular. A clamping portion 1683 that faces the spherical recessed cavity 1010 on the horizontal connector 1680 and extends along an arc-shaped surface of the extension portion 1030 is formed on a surface, away from the spherical protrusion 1020, of the third stopper 1682.

As shown in FIG. 8, a specific assembled container house system using the assembly for an assembled container house system in Embodiment 3 is listed below. The assembled container house system is formed by an assembly plate, where the an assembly plate is formed by four semi-auxiliary wallboards 1195, one auxiliary wallboard 1190, one second main wallboard 1200, two first main wallboard 1100, one semi-main wallboard 1150, and 18 horizontal connectors 1680.

Certainly, it may be understood that the assembly plate may further be spliced in other manners, so that assembly plates with different sizes are formed to satisfy the actual requirements. The assembly plate is equivalent to a first main wallboard after being completed, but the assembly plate has a size greater than that of the first main wallboard, and has more free extension portions and spherical protrusions 1020 than the first main wallboard, as shown in FIG. 8, but the form of the assembly plate is similar to the form of the first main wallboard. On such basis, the splicing manners such as those stated in Embodiment 1 and Embodiment 2 may be completed by using the assembly plate, so as to complete the assembled container house system.

Embodiment 4

Figure 17A:
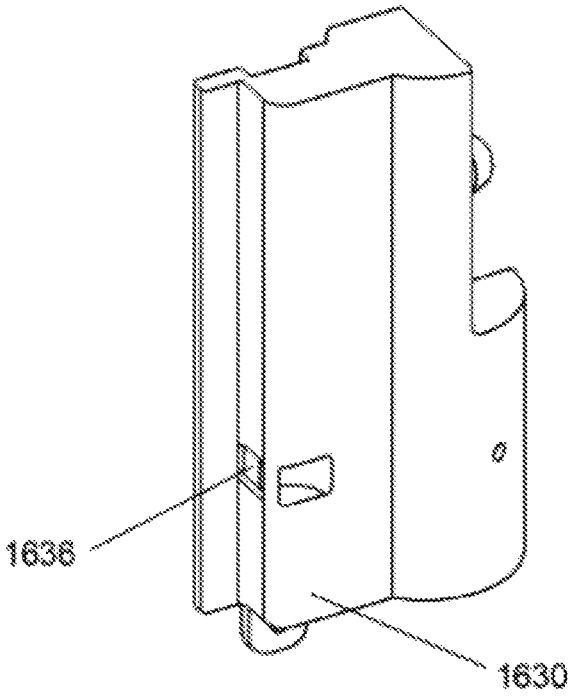
FIG. 17*a* is a stereoscopic schematic structural diagram from a front viewing angle of a first corner doorframe according to Embodiment 4.
Figure 17B:
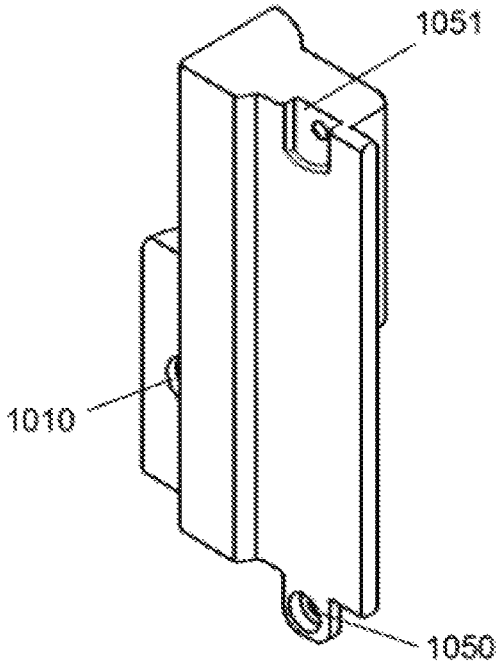
FIG. 17*b* is a stereoscopic schematic structural diagram from a back viewing angle of the first corner doorframe according to Embodiment 4.
Figure 18:
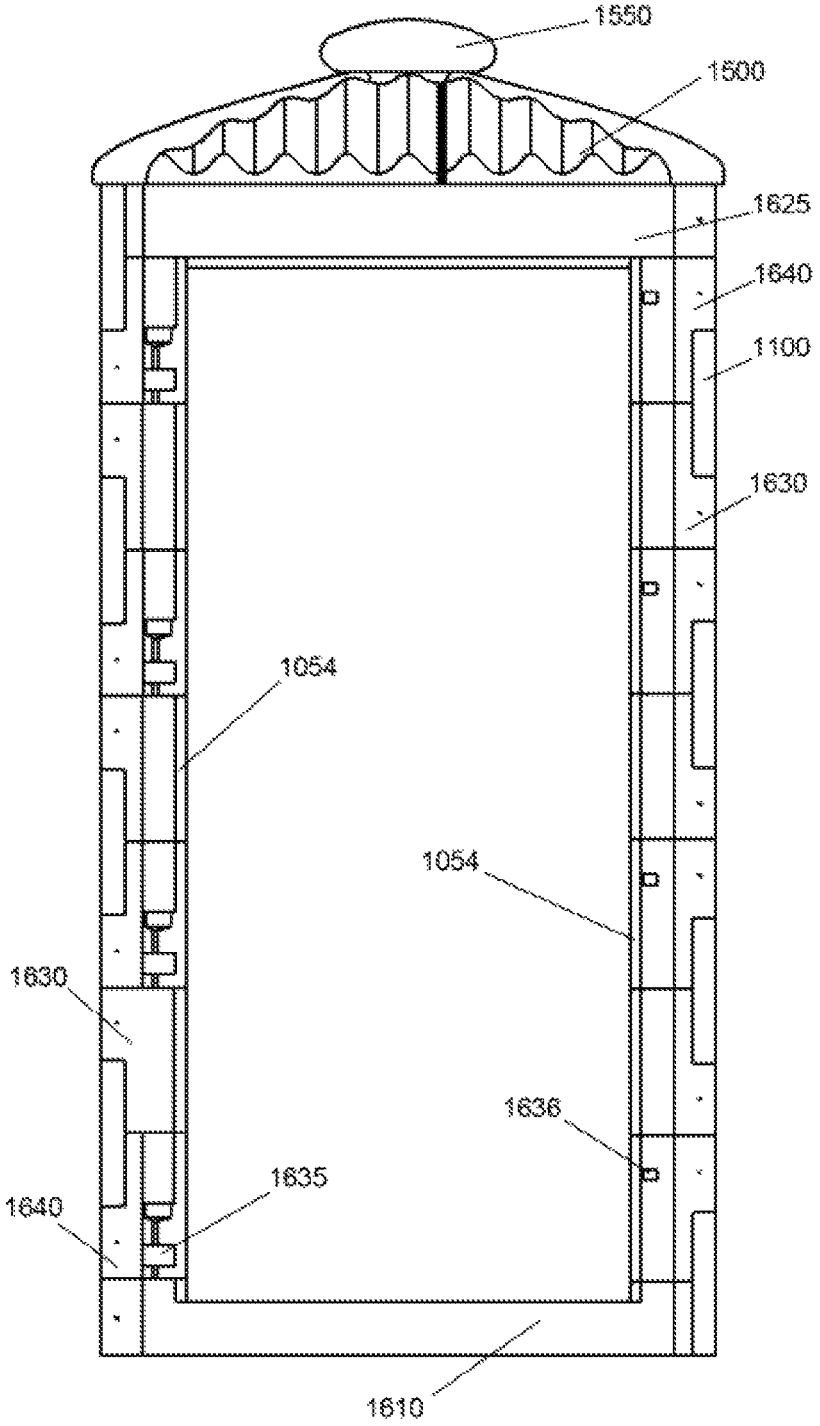
FIG. 18 is a schematic structural diagram of a third form of the assembled container house system according to Embodiment 4.

As shown in FIG. 13 to FIG. 18, it should be noted herein that nouns of locality, i.e., left and right used for describing a door plate 1400, a threshold 1610, a door beam 1625, a first corner doorframe 1630, and a second corner doorframe 1640 are all defined with reference to the view shown in FIG. 18. It should be understood that use of the nouns of locality should not limit the protection scope of this application. Based on Embodiment 2, the assembly for an assembled container house system further includes a door plate 1400, a threshold 1610, a door beam 1625, a first corner doorframe 1630, and a second corner doorframe 1640, wherein the door plate 1400 has a rotation portion hingedly connected to a wallboard; the threshold 1610 is recessed; a spherical protrusion 1020 is formed on a right side surface of the threshold 1610 by means of protruding rightwards; a left side of the threshold 1610 protrudes to form a second extension portion of which a rear end surface has a spherical recessed cavity 1010; an axis of the spherical protrusion 1020 on the threshold 1610 is perpendicular to an axis of the spherical recessed cavity 1010 on the threshold 1610; the door beam 1625 is T-shaped; a spherical protrusion 1020 is formed on a left side surface of the door beam 1625 by means of protruding leftwards; a right side of the door beam 1625 protrudes to form a second extension portion of which a rear end surface has a spherical recessed cavity 1010; an axis of the spherical protrusion 1020 on the door beam 1625 is perpendicular to an axis of the spherical recessed cavity 1010 on the door beam 1625; a second extension portion of which a rear end surface has a spherical recessed cavity 1010 is integrally formed on a bottom half portion of a right side of the first corner doorframe 1630; a spherical protrusion 1020 is formed on a top half portion of the right side of the first corner doorframe 1630 by means of protruding rightwards; an axis of the spherical protrusion 1020 on the first corner doorframe 1630 is perpendicular to an axis of the spherical recessed cavity 1010 on the first corner doorframe 1630; a second extension portion of which a rear end surface has a spherical recessed cavity 1010 is integrally formed on a top half portion of a right side of the second corner doorframe 1640; a spherical protrusion 1020 is formed on a bottom half portion of the right side of the second corner doorframe 1640 by means of protruding rightwards; and an axis of the spherical protrusion 1020 on the second corner doorframe 1640 is perpendicular to an axis of the spherical recessed cavity 1010 on the second corner doorframe 1640. The height of the second extension portion is preferably a half of the height of the extension portion.

Figure 16A:
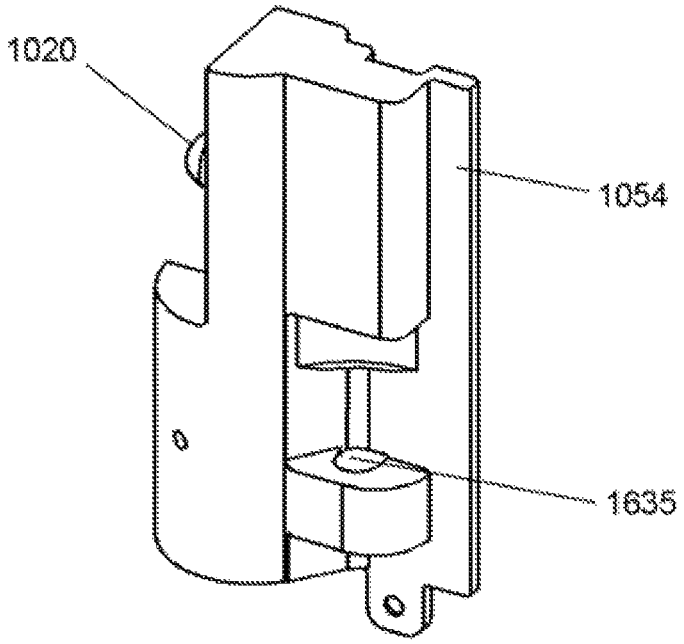
FIG. 16*a* is a stereoscopic schematic structural diagram from a front viewing angle of a second corner doorframe according to Embodiment 4.
Figure 16B:
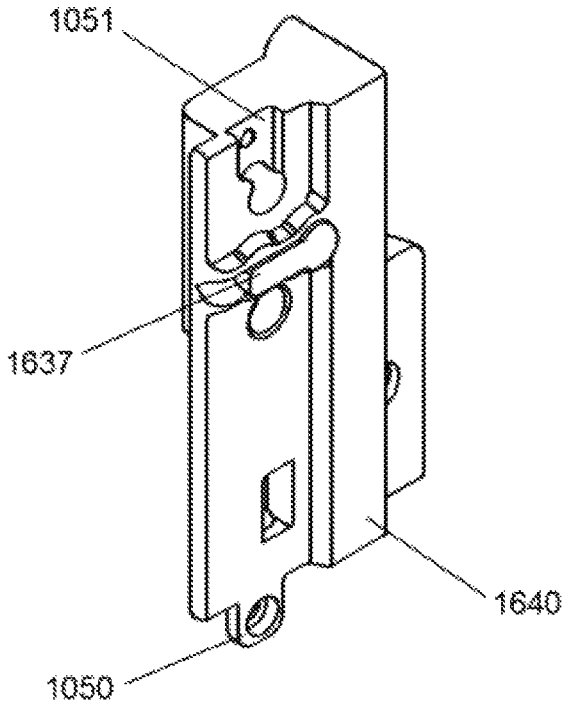
FIG. 16*b* is a stereoscopic schematic structural diagram from a back viewing angle of the second corner doorframe according to Embodiment 4.

As shown in FIG. 16*a* and FIG. 16*b*, preferably, the second corner doorframe 1640 is provided with a shaft hole 1635 configured to install a shaft of a door plate.

As shown in FIG. 17*a* and FIG. 17*b*, preferably, the first corner doorframe 1630 is provided with a lock hole 1636 configured to install a padlock.

As shown in FIG. 16*a* and FIG. 16*b*, preferably, the second corner doorframe 1640 is slidably connected to a sliding block 1637 configured to connect a sliding door rope.

Figure 13:
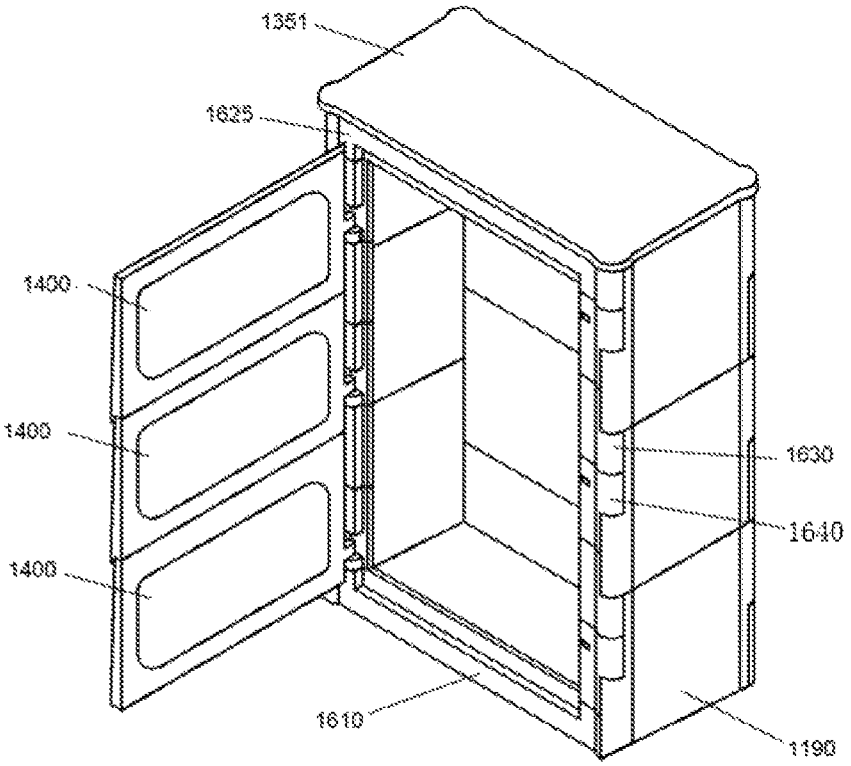
FIG. 13 is a stereoscopic schematic structural diagram of a second form of the assembled container house system according to Embodiment 4.
Figure 14:
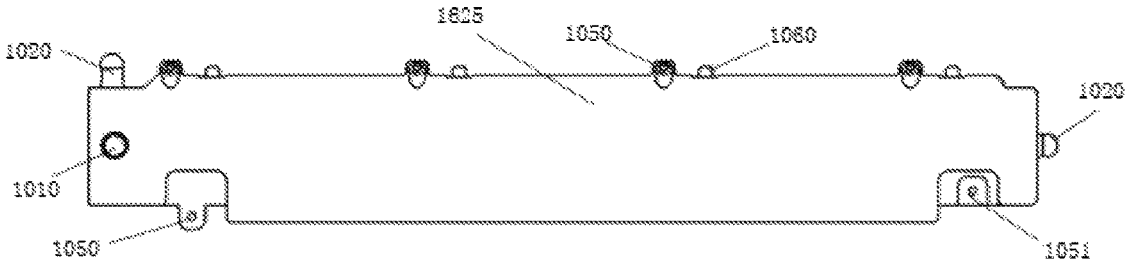
FIG. 14 is a schematic structural diagram of a door beam according to Embodiment 4.
Figure 15:
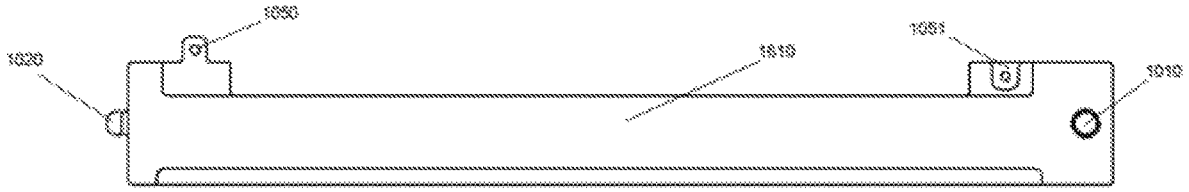
FIG. 15 is a schematic structural diagram of a threshold according to Embodiment 4.

As shown in FIG. 18, when the various components for an assembled container house system in Embodiment 4 are spliced, a combination of the door plate 1400, the threshold 1610, the door beam 1625, the first corner doorframe 1630, and the second corner doorframe 1640 may be used to replace a fixed plane, such as a front end surface, of the assembled container house system shown in Embodiment 2, so that the fixed plane becomes a plane that may be opened and closed. As shown in FIG. 18, the first corner doorframe 1630 and second corner doorframe 1640 are connected to the first main wallboards 1100 on the left and the right sides. The spherical protrusions 1020 of the first corner doorframe 1630 and the second corner doorframe 1640 are inserted into the spherical recessed cavities 1010 of the first main wallboards 1100, and the spherical protrusions 1020 of the first main wallboards 1100 are inserted into the spherical recessed cavities 1010 of the first corner doorframe 1630 and the second corner doorframe 1640, so as to form self locking. The door plate 1400 is rotatably connected to the second corner doorframe 1640 by using the shaft of the door plate. Inner sides of the first corner doorframe 1630 and the second corner doorframe 1640 have door stops 1054 that performs the function of limiting an angle by which the door plate 1400 rotates inwards (within the container house). During splicing, the door beam 1625 is located on a top portion of the assembled container house system, the threshold 1610 is located on a bottom portion of the assembled container house system, and a roof or a fixed cover top 1351 is detachably connected above the door beam (as shown in FIG. 13).

The assembly for an assembled container house system may further include a wallboard 1180 provided with a door hole, where the structure of the wallboard 1180 provided with a door hole is the same as the structure of the first main wallboard 1100 or the second main wallboard 1200; and the wallboard 1180 provided with a door hole is provided with a door hole 1181. In this way, the wallboard 1180 provided with a door hole may be used to replace one or some first main wallboards 1100 and second main wallboards 1200. The door hole 1181 may be installed with an ancillary window having a sealing ring and a transparent sheet, or may be installed with an ancillary door that can be opened and closed, for taking and placing articles in the house.

Figure 21:
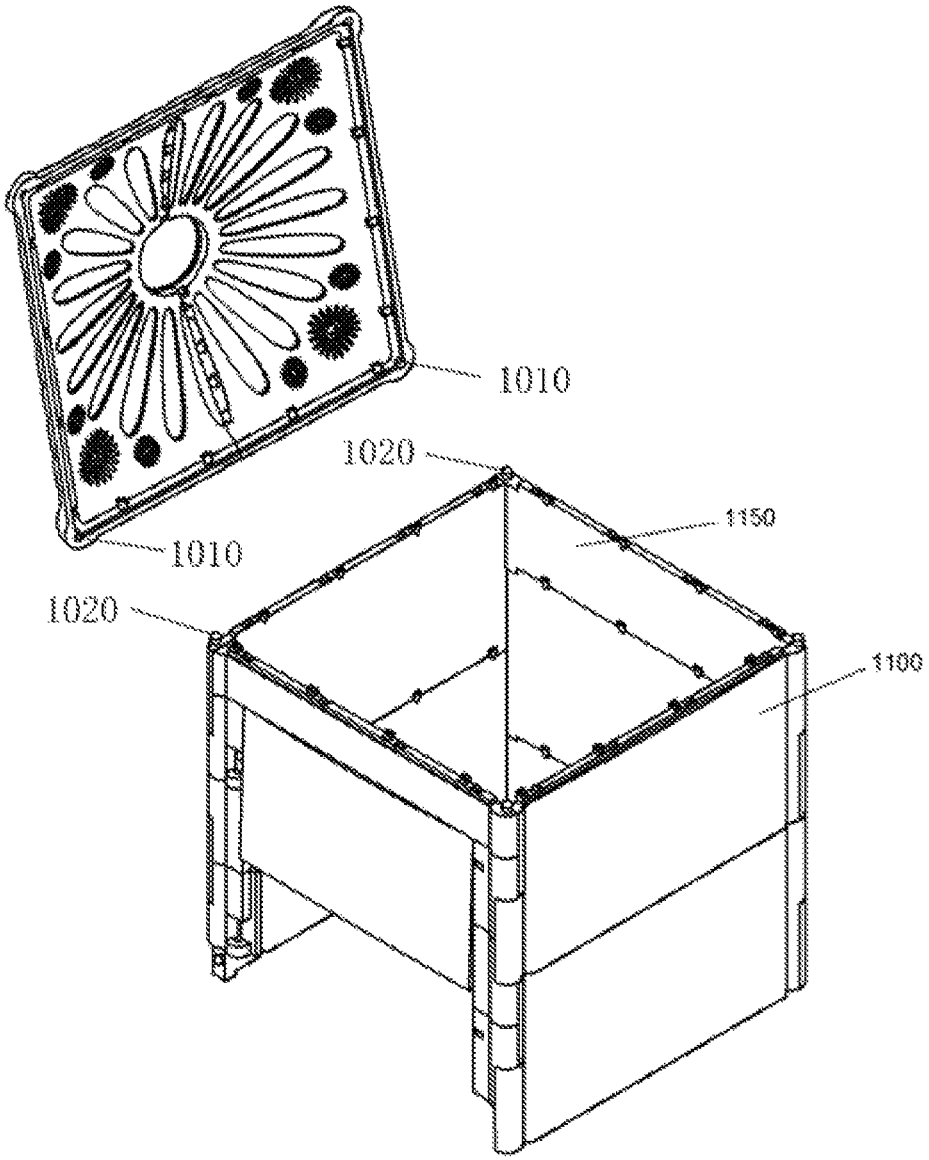
FIG. 21 is a stereoscopic schematic structural diagram after a roof in FIG. 18 is opened.

As shown in FIG. 21, to seal the top portion of the assembled container house system, the assembly for an assembled container house system further includes a roof.

Preferably, spherical recessed cavities 1010 are formed on four corners on a bottom surface of the roof. A top surface of the second extension portion of the door beam 1625 protrudes upwards to form a spherical protrusion 1020. Spherical protrusions 1020 are formed on both a top surface of an extension portion of the semi-main wallboard 1150 located on the topmost of the assembled container house system and a top surface of an extension portion of the first main wallboard 1100 located on the topmost of the assembled container house system by means of protruding upwards. The roof is connected to one semi-main wallboard 1150, left and right first main wallboards 1100, and a door beam 1625 by means of a match between the spherical recessed cavities 1010 and the spherical protrusions 1020. Further, top surfaces of the semi-main wallboard 1150, the first main wallboards 1100, and the door beam 1625 are provided with column pins, and a bottom surface of the roof is provided with holes matching the column pins.

Figure 19:
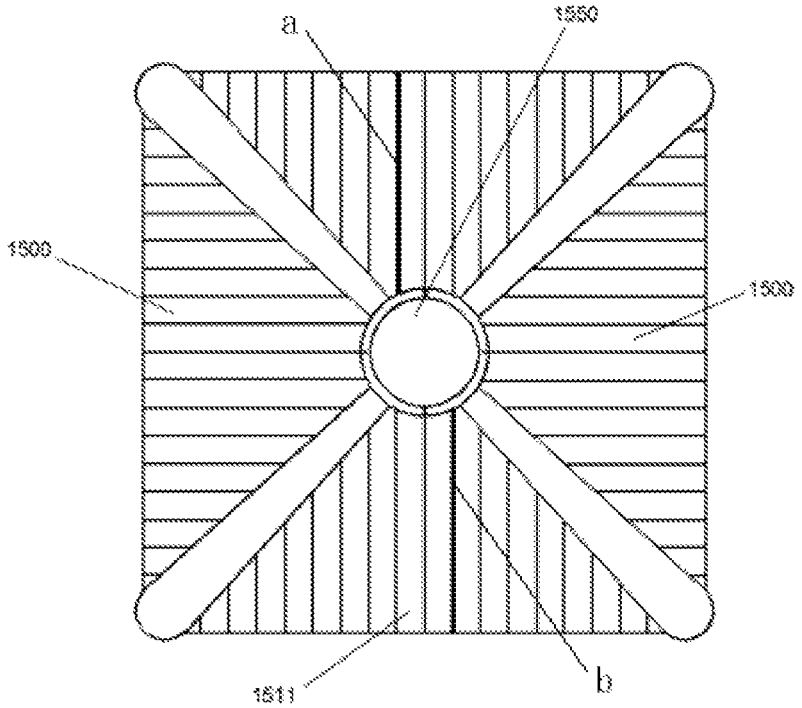
FIG. 19 is a schematic structural diagram of a first form of a roof according to the present invention.

As shown in FIG. 19 and FIG. 21, preferably, the roof includes two main roofs 1500 that may be assembled with each other, where a daylighting, rainproof, and ventilating skylight 1550 may be assembled between the two main roofs 1500. As shown in FIG. 19, the main roofs 1500 may be assembled by using the following solution: the main roofs are L-shaped; a spherical protrusion 1020 is formed on a first right side vertical plane a of the main roof on the left side in a protruding manner; and a spherical recessed cavity 1010 matching the spherical protrusion 1020 is formed on a second right side vertical plane b of the main roof on the left side in a recessed manner; the structure of the main roof on the right side is completely the same as that of the main roof on the left side, and therefore, the main roof on the left side and the main roof on the right side (being overturned by 180 degrees) may be assembled and fastened together. Certainly, it may be understood that the present invention is not limited only to this implementation. For example, the spherical protrusion 1020 may be formed on the second right side vertical surface b, and the spherical recessed cavity 1010 may be formed on the first right side vertical surface a. Therefore, there are a lot of forms, and details are not described herein again.

Figure 20:
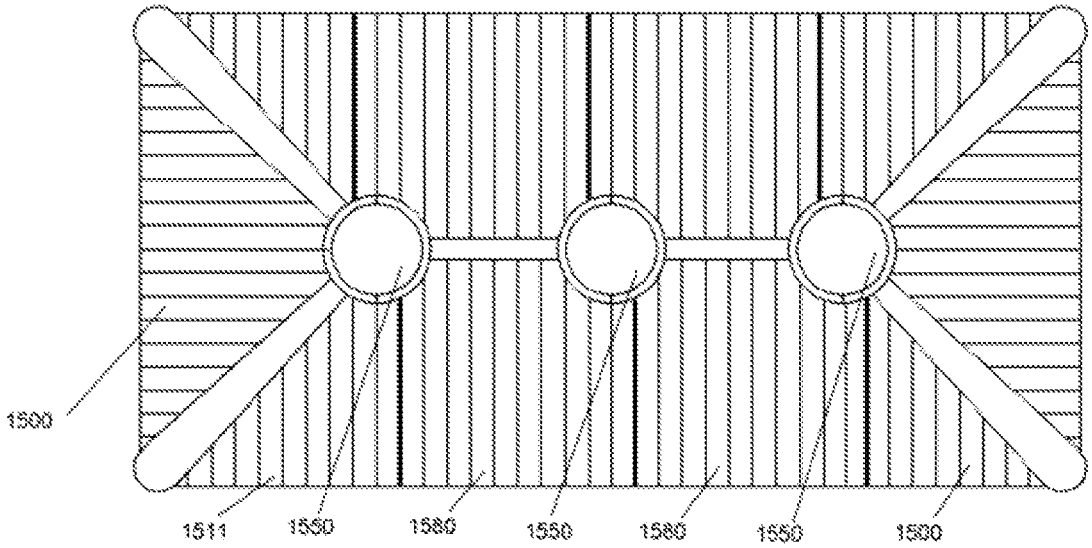
FIG. 20 is a schematic structural diagram of a second form of the roof according to the present invention.
Figure 27:
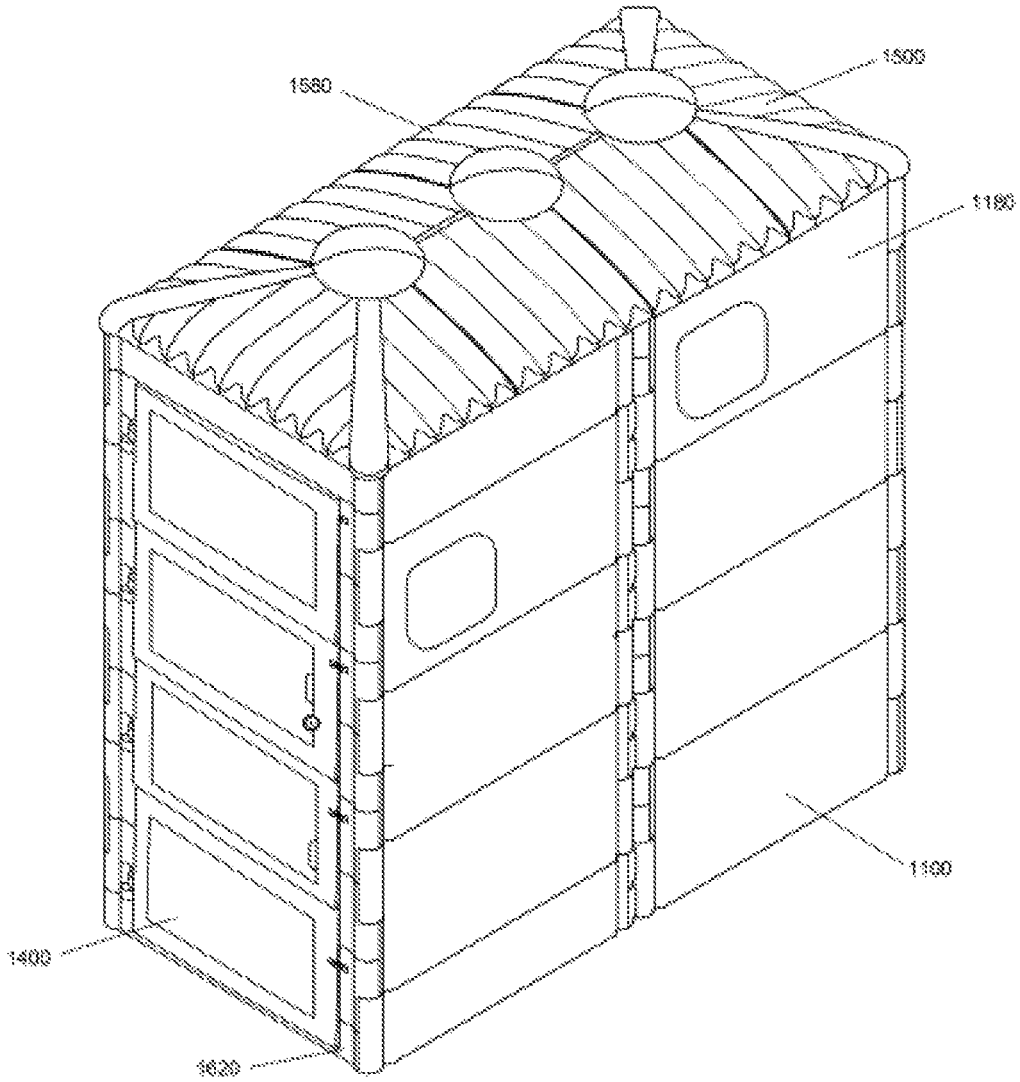
FIG. 27 is a schematic diagram of an elongated assembled house.

As shown in FIG. 20 and FIG. 27, further, the roof may further include at least one auxiliary roof 1580. The auxiliary roof 1580 is assembled between the two main roofs 1500, and the daylighting, rainproof, and ventilating skylight 1550 is assembled between the main roofs 1500 and the auxiliary roof 1580 and between adjacent auxiliary roofs 1580. The main roofs 1500 and the auxiliary roof 1580 are provided with rainproof strips 1511. The roof may be extended by using the auxiliary roof 1580. The auxiliary roof 1580 and the main roof 1500 may be assembled by using the following solution: the main roof 1500 is L-shaped; the auxiliary roof 1580 is Z-shaped, and a protrusion portion on a side surface thereof is fastened into a recessed portion of the main roof 1500; and a protrusion portion of the main roof 1500 is fastened into a recessed portion on a side surface of the auxiliary roof 1580.

Figure 12:
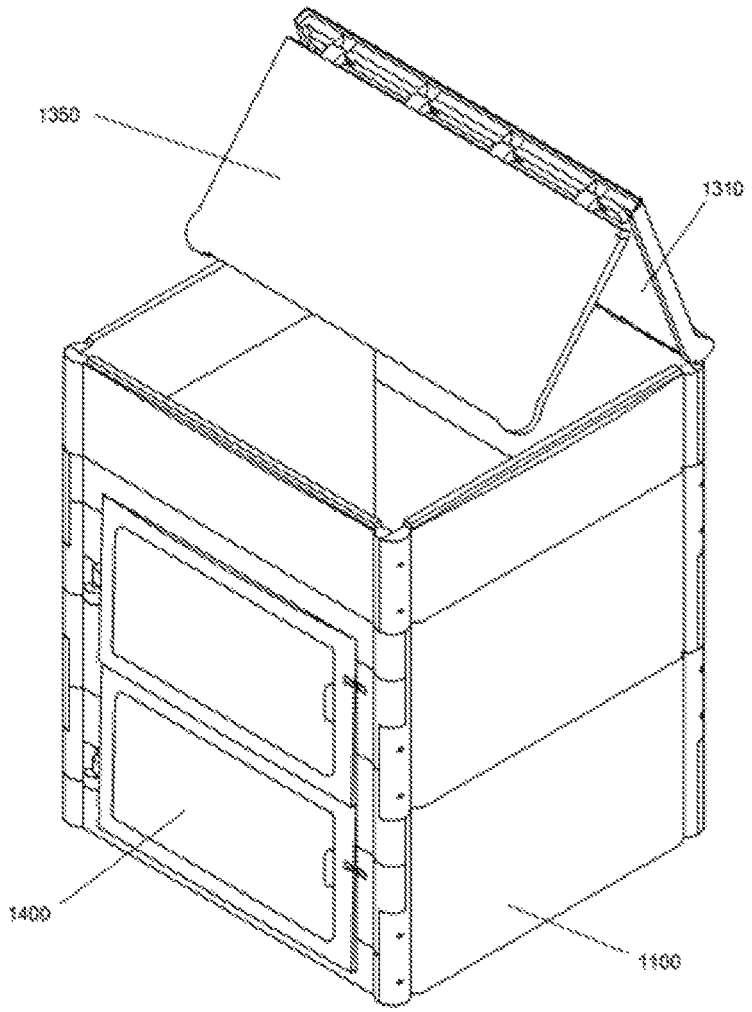
FIG. 12 is a stereoscopic schematic structural diagram of a first form of an assembled container house system according to Embodiment 4.
Figure 26:
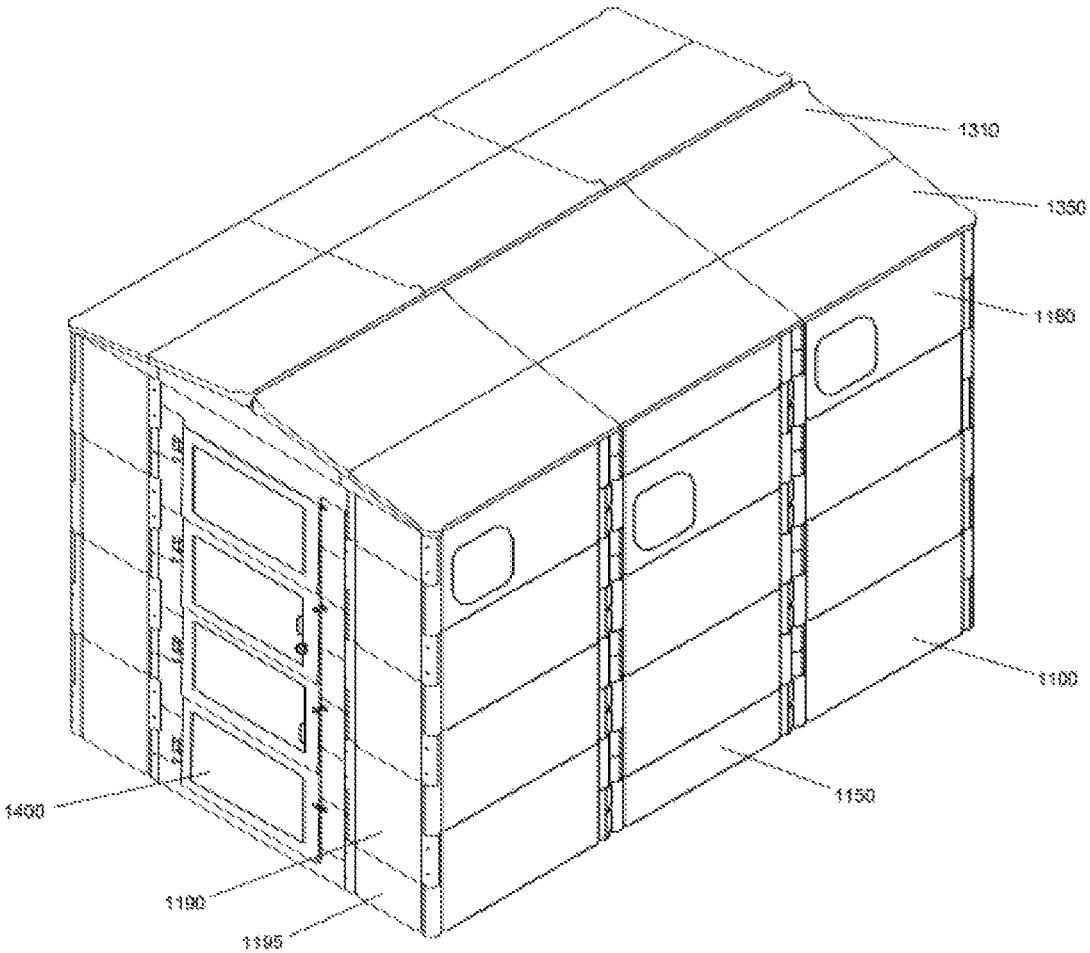
FIG. 26 is a schematic structural diagram showing that four wallboards extend to match a bidirectional roof.

To seal the top portion of the assembled container house system, the assembly for an assembled container house system may also include an upper cover, where the upper cover is in one of the following two forms:

as shown in FIG. 5, form 1): the upper cover is an integral board 1300;

as shown in FIG. 12 and FIG. 26, form 2): the upper cover is formed by a first folded plate 1310 and a second folded plate 1350, where the first folded plate 1310 is hingedly connected to the second folded plate 1350.

As shown in FIG. 26 and FIG. 27, the assembly for an assembled container house system further includes a door plate 1400, a threshold 1610, a door beam 1625, a first corner doorframe 1630, and a second corner doorframe 1640, and based on Embodiment 3, the assembly for an assembled container house system may be spliced to combine a large house structure.

Figure 22:
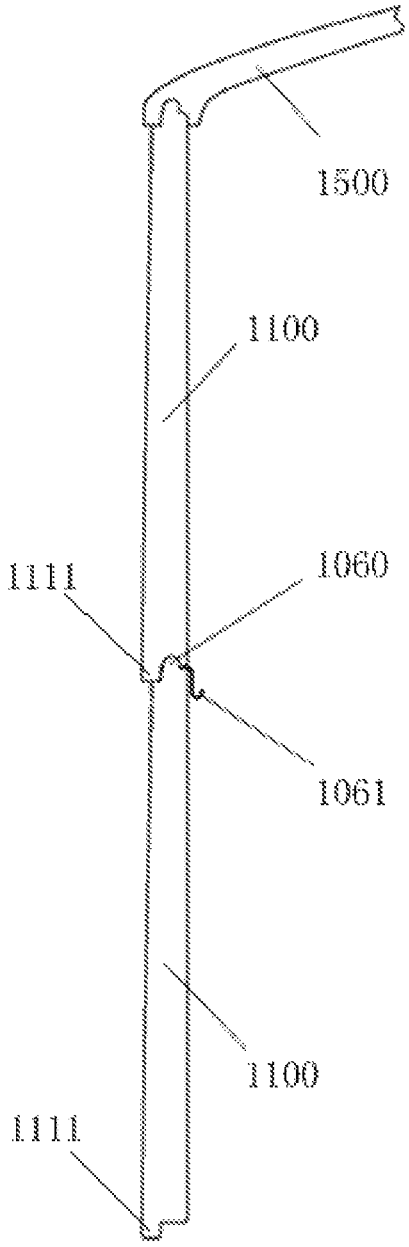
FIG. 22 is a schematic structural sectional view after upper and lower first main wallboards are spliced according to the present invention.

As shown in FIG. 22, when the assembly for an assembled container house system needs to be spliced into a house for use, preferably, both the first main wallboard 1100 and the second main wallboard 120 have a thick bottom portion and a thin top portion. In this way, a flange is formed between the first main wallboards 1100 spliced in an up-and-down manner (an outer end of a bottom portion of a first main wallboard 1100 on an upper layer exceeds an outer end of a top portion of a first main wallboard 1100 on a lower layer). With reference to FIG. 22, a left end of the bottom portion of the first main wallboard 1100 on the upper layer exceeds a left end of the top portion of the first main wallboard 1100 on the lower layer. A flange may also be formed between the second main wallboards 1200 spliced in an up-and-down manner, so as to reduce rain that flows into a seam between the first main wallboards 1100 spliced in an up-and-down manner, and this also applies to the second main wallboards 1200 spliced in an up-and-down manner, and this waterproof structure is an I-shaped structure.

As shown in FIG. 22, preferably, bottom surfaces of the first main wallboard 1100 and the second main wallboard 1200 protrude downwards to form an elongated step 1111 extending along a length direction of a wallboard, where the thickness of the step 1111 is smaller than the thicknesses of the bottom surfaces of the first main wallboard 1100 and the second main wallboard 1200; and top surfaces of the first main wallboard 1100 and the second main wallboard 1200 are recessed downwards to form a recess extending along a length direction of a wallboard, where the thickness of the step 1111 is greater than the thickness of the recess. In this way, the rain may be further prevented from flowing into the seam between the first main wallboards 1100 spliced in an up-and-down manner, and this also applies to the second main wallboards 1200 spliced in an up-and-down manner. Therefore, the waterproof structure is an L-shaped mirror structure.

As shown in FIG. 22, the assembly for an assembled container house system may further include a hook 1061, where the hook 1061 is provided with a through hole capable of being sleeved on a column pin 1060. The hook 1061 is clamped between wallboards, and may be configured to suspend a shelf or other articles inside or outside the house.

Figure 23:
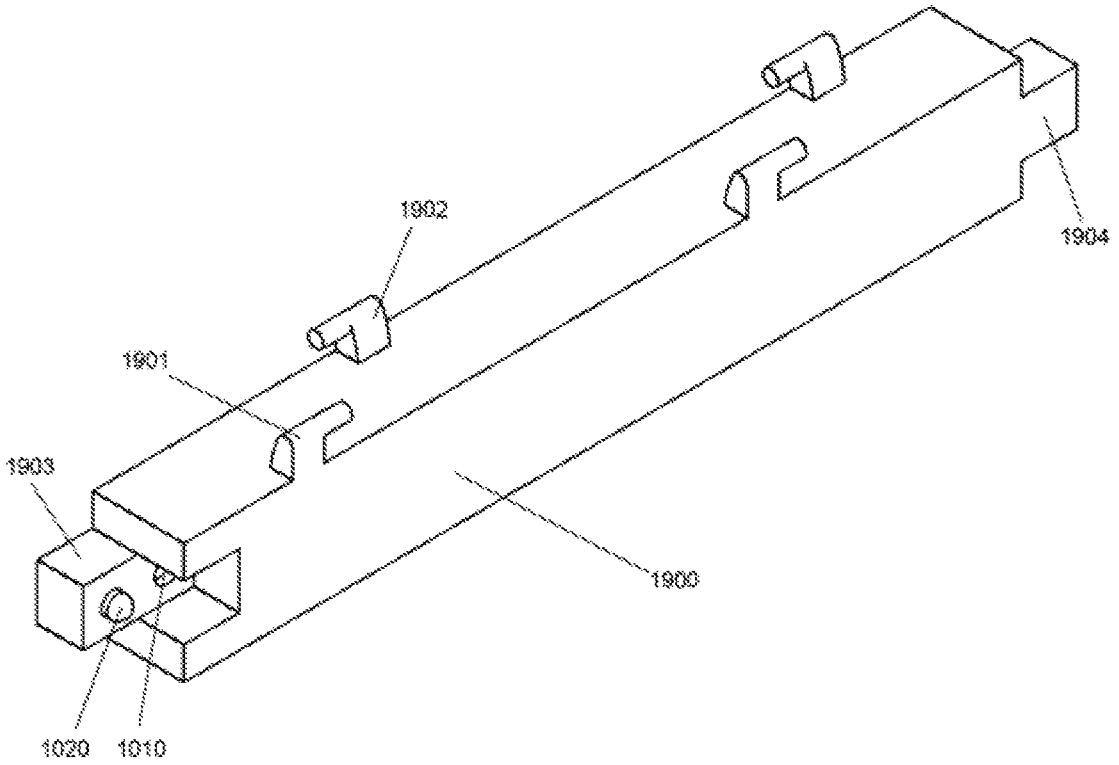
FIG. 23 is a stereoscopic schematic structural diagram of primary beam members according to the present invention.
Figure 24:
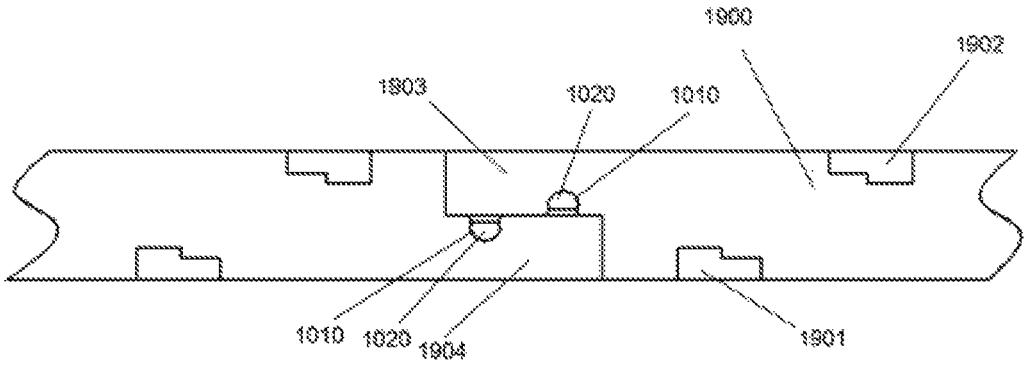
FIG. 24 is a schematic structural diagram after the primary beam members are combined according to the present invention.
Figure 25:
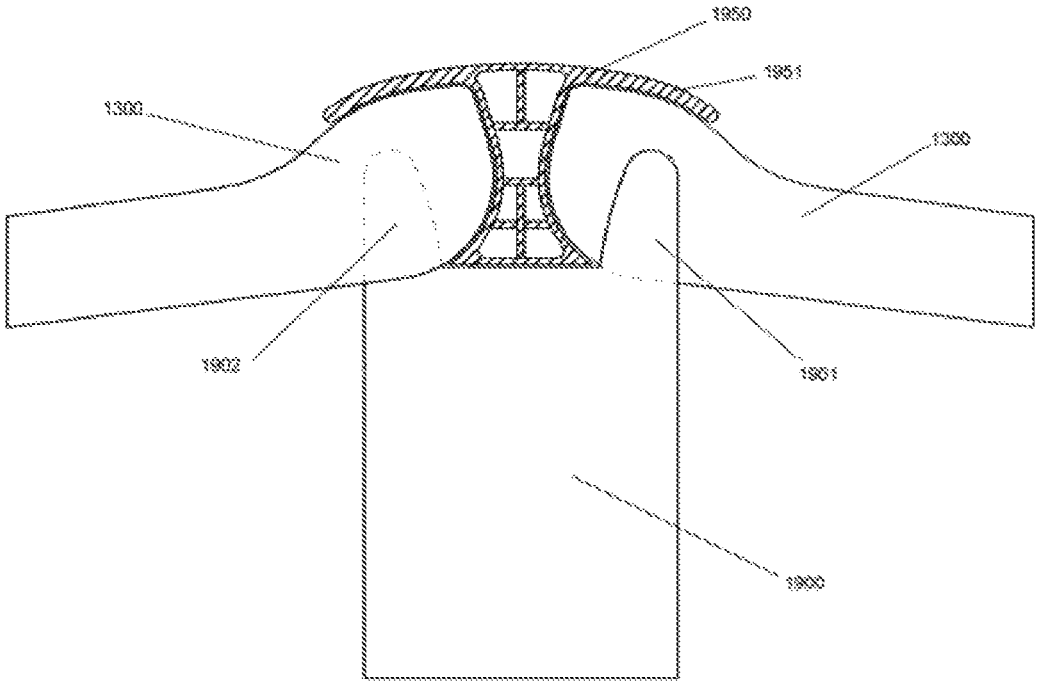
FIG. 25 is a schematic structural diagram after a primary beam, an elastic body, and an integral board are combined according to the present invention.

As shown in FIG. 23 to FIG. 25, to form a house for use by using the assembly for an assembled container house system, the assembly for an assembled container house system may further include a roof ridge, where the roof ridge is formed by a primary beam, an elastic body 1950, and an integral board 1300 that is installed on two sides of the primary beam in a matching manner. The primary beam is formed by sequentially splicing a plurality of primary beam members 1900 from left to right. A left splicing portion 1903 of the primary beam member matches a right splicing portion 1904 of the primary beam member 1900, and the left splicing portion 1903 and the right splicing portion 1904 are provided with a spherical protrusion 1020 and a spherical recessed cavity 1010 matching each other. An upper end surface of the primary beam member 1900 is provided with a first hook-like structure 1901 and a second hook-like structure 1902 that are distributed in a staggered manner and are opposite to each other. The elastic body 1950 is T-shaped. An inner end of the integral board 1300 is located between the first hook-like structure 1901 and the second hook-like structure 1902 that are opposite to each other and is located between an arm 1951 of the elastic body 1950 and a top surface of the primary beam member 1900.

As shown in FIG. 25, further, the arm 1951 of the elastic body 1950 is an arc-shaped rainproof arm extending downwards from the center to both sides. The arm 1951 may perform a rainproof function, so that the rain can flow to both sides along the arm 1951 in time.

As shown in FIG. 23, further, axes of the spherical protrusions 1020 and the spherical recessed cavities 1010 on the left splicing portion 1903 and the right splicing portion 1904 are parallel to the top surface of the primary beam member 1900. In this way, the primary beam may bear greater pressure.

Preferably, the first main wallboard 1100, the second main wallboard 1200, the semi-main wallboard 1150, the auxiliary wallboard 1190, the semi-auxiliary wallboard 1195, the door plate 1400, the threshold 1610, the door beam 1625, the first corner doorframe 1630, and the second corner doorframe 1640 are all provided with a plastic feedthrough expansion rivet sub-structure 1050 and a plastic feedthrough expansion rivet parent structure 1051 matching each other, where various components may be enabled to be connected to each other more firmly by means of a match between the plastic feedthrough expansion rivet sub-structure 1050 and the plastic feedthrough expansion rivet parent structure 1051, and by riveting a plastic feedthrough expansion rivet.

In addition, it should be noted that preferably, the spherical protrusions 1020 and the spherical recessed cavities 1010 of all components have a same specification. That is, preferably, all spherical protrusions 1020 and spherical recessed cavities 1010 are the same, regardless of the components where they are located. Preferably, all extension portions also have a same specification, regardless of the components where they are located. Preferably, all second extension portions also have a same specification, regardless of the components where they are located. The specification includes two elements, i.e., shape and size at the same time.

Figure 28:
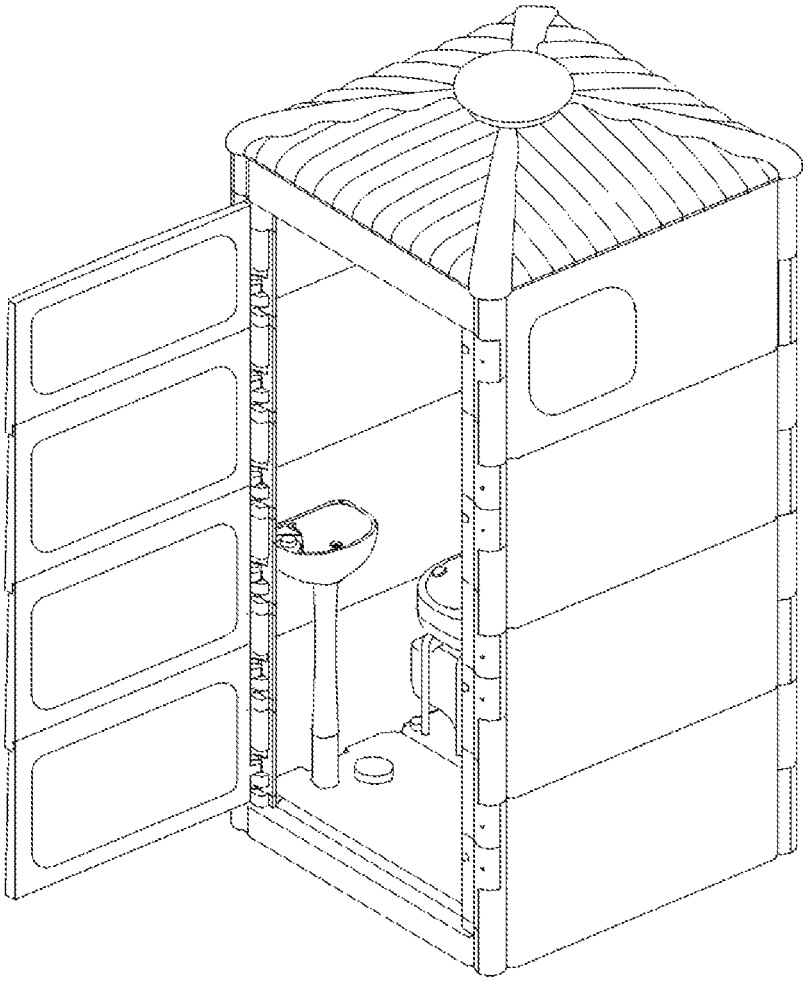
FIG. 28 is a stereoscopic schematic structural diagram of an integral bathroom according to the present invention.
Figure 29:
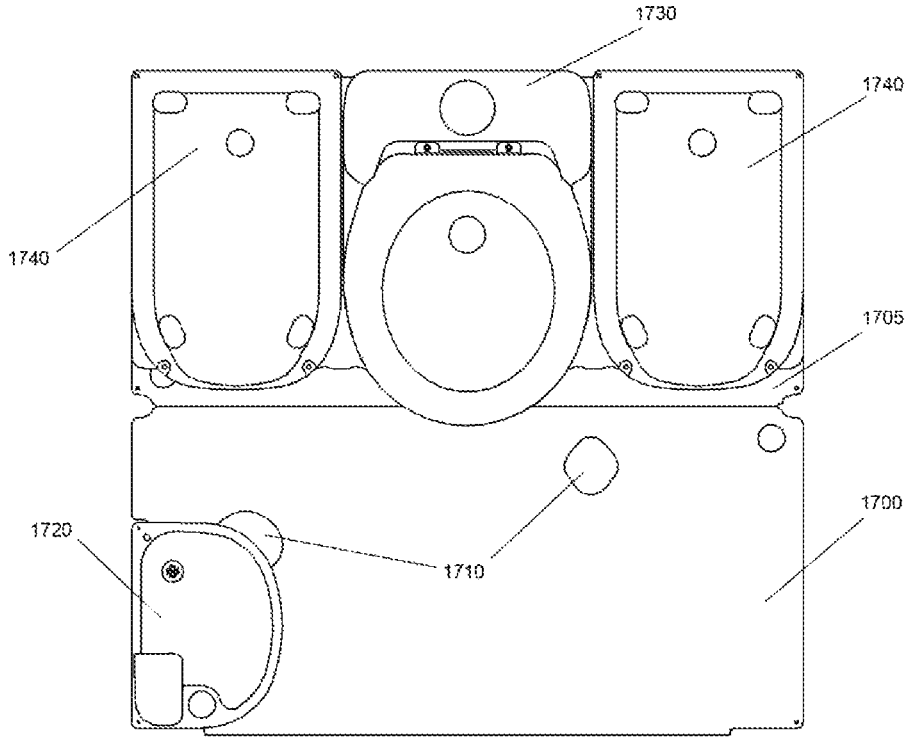
FIG. 29 is a schematic plane view of the integral bathroom according to the present invention.

Based on Embodiment 4, the assembled container house system may be used as an assembled integral bathroom. As shown in FIG. 28 and FIG. 29, a washbasin 1720, an outer-side ground water tank 1700, an inner-side ground water tank 1705, a plastic telescopic foot pump 1710 protected by a rubber sleeve, a closestool 1730 that can store water and has a flushing structure, and an auxiliary tank 1740 may be placed therein.

Figure 30:
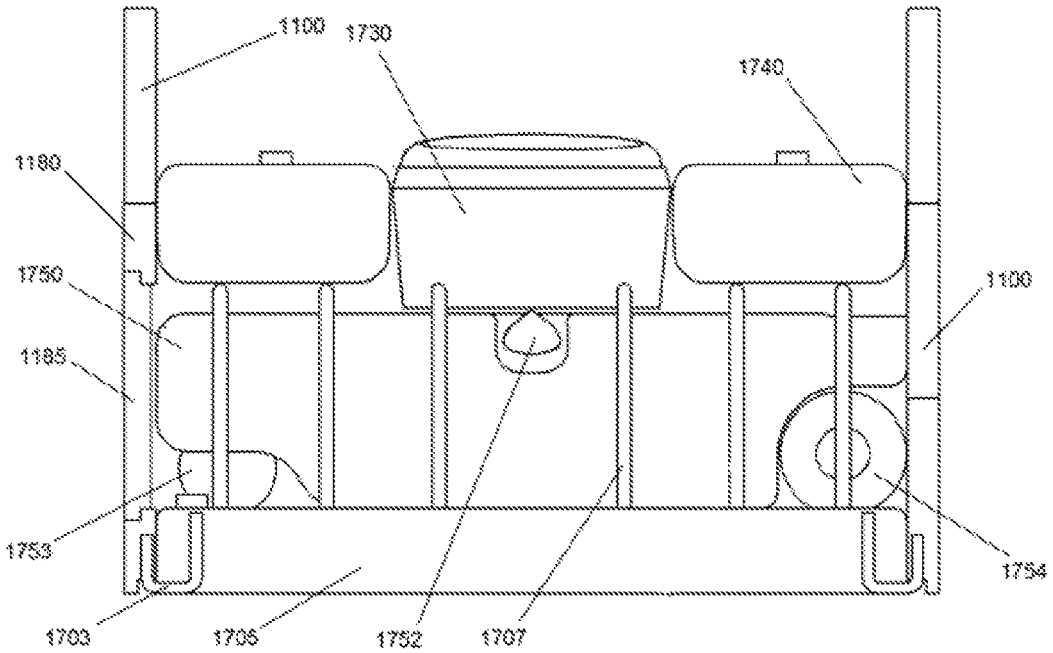
FIG. 30 is a schematic diagram of upper and lower structures of the integral bathroom according to the present invention.
Figure 34:
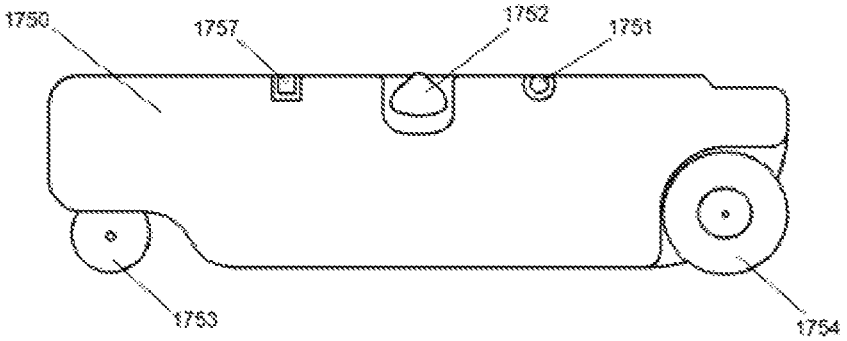
FIG. 34 is a schematic structural front view of a three-wheel horizontal movable drain tank according to the present invention.
Figure 35:
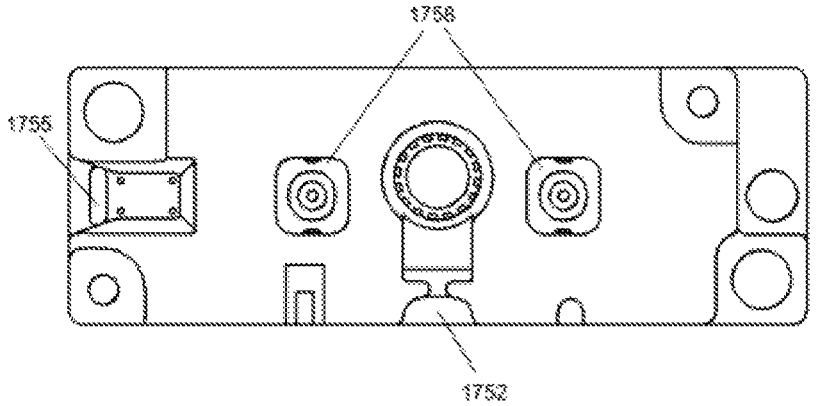
FIG. 35 is a schematic structural top view of the three-wheel horizontal movable drain tank according to the present invention.
Figure 36:
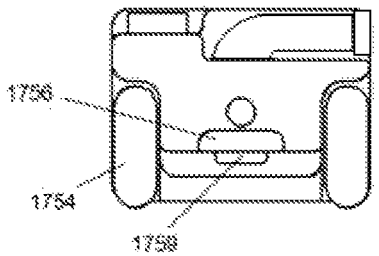
FIG. 36 is a schematic structural side view of the three-wheel horizontal movable drain tank according to the present invention.

As shown in FIG. 30, a support 1707 may be installed on the inner-side ground water tank 1705, where the support 1707 supports the closestool 1730 and the auxiliary tank 1740; and a three-wheel horizontal movable drain tank 1750 may be taken out or pushed in through a door hole 1181 on a wallboard 1180 provided with a door hole, where a door 1185 that can be opened and closed may be installed at the door hole 1181. One side of a U-shaped metal hook 1703 is in the inner-side ground water tank 1705, and the other side is in the first main wallboard 1100, thereby further enhancing the entire rigidity. The three-wheel horizontal movable drain tank 1750 is provided with a sealing valve 1752. A bottom portion of the three-wheel horizontal movable drain tank 1750 is provided with a single universal wheel 1753 in the front and two rear wheels 1754. As shown in FIG. 34 to FIG. 36, the three-wheel horizontal movable drain tank 1750 may be provided with a front universal wheel 1753, two rear fixed wheels 1754, a front handle 1755, and a rear hidden handle 1756. A top portion of the three-wheel horizontal movable drain tank 1750 is provided with a sealing valve 1752, an exhaust valve 1751, a liquid level display 1757, and two mounted handles 1758. The bottom portion of the three-wheel horizontal movable drain tank 1750 is provided with a discharging threaded port 1759.

Figure 31:
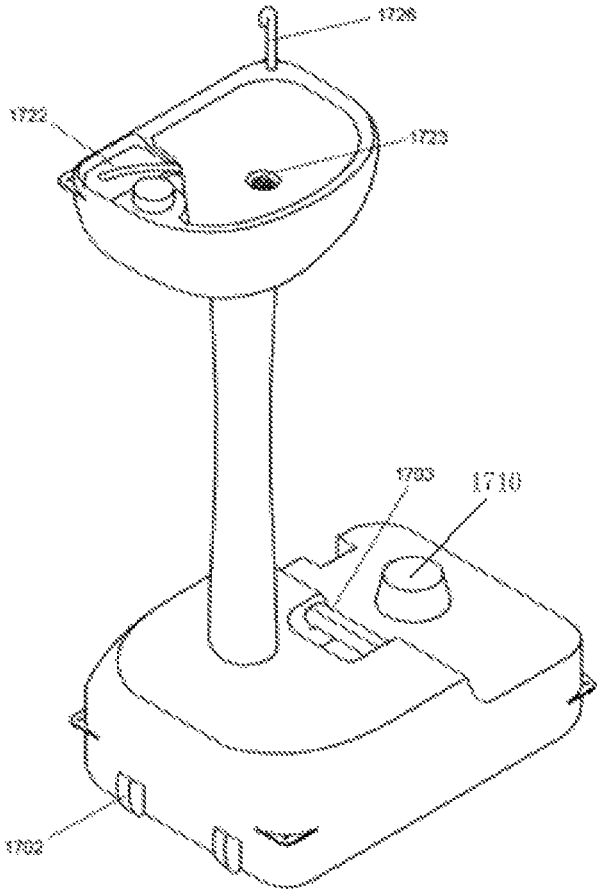
FIG. 31 is a schematic diagram of a portable washbasin according to the present invention.

As shown in FIG. 31, it is a standard configuration for a bathroom that the washbasin 1720 of the present invention is installed on the outer-side ground water tank 1700 by using a support column 1721. If the washbasin 1720 is installed on a portable and movable water tank, and the foot pump 1710 is installed, a portable washbasin is formed. The washbasin 1720 may be equipped with a water faucet 1726, a discharge port 1723, and a hand cleaner platform 1722. A bottom portion of the outer-side ground water tank 1700 is equipped with two wheels 1702.

Figure 32:
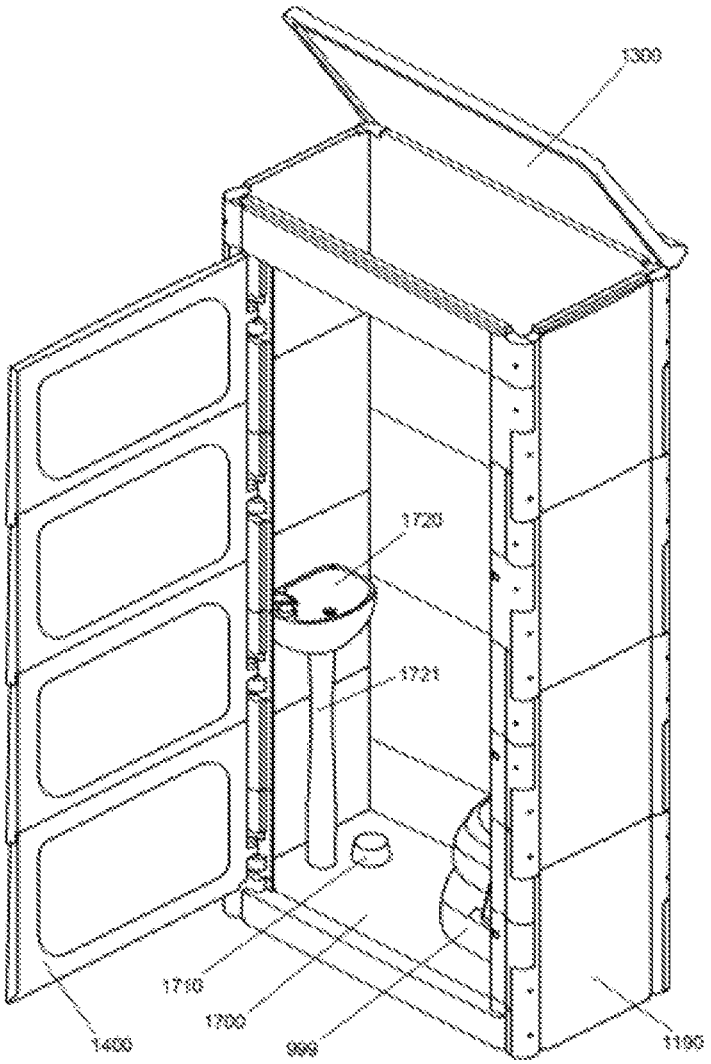
FIG. 32 is a schematic structural diagram of an integral bathroom having an upper flip cover according to the present invention.

As shown in FIG. 32, the integral bathroom of the present invention may further be equipped with an upper flip cover so as to ventilate in time. The upper flip cover is an integral board 1300 and is rotatably connected to a top portion of the integral bathroom. A water tank 1700, a washbasin 1720, a support column 1721, and a foot pump 1710 are placed within the integral bathroom, and other portable closestools 999 may be placed in the remaining space of the integral bathroom.

Figure 33:
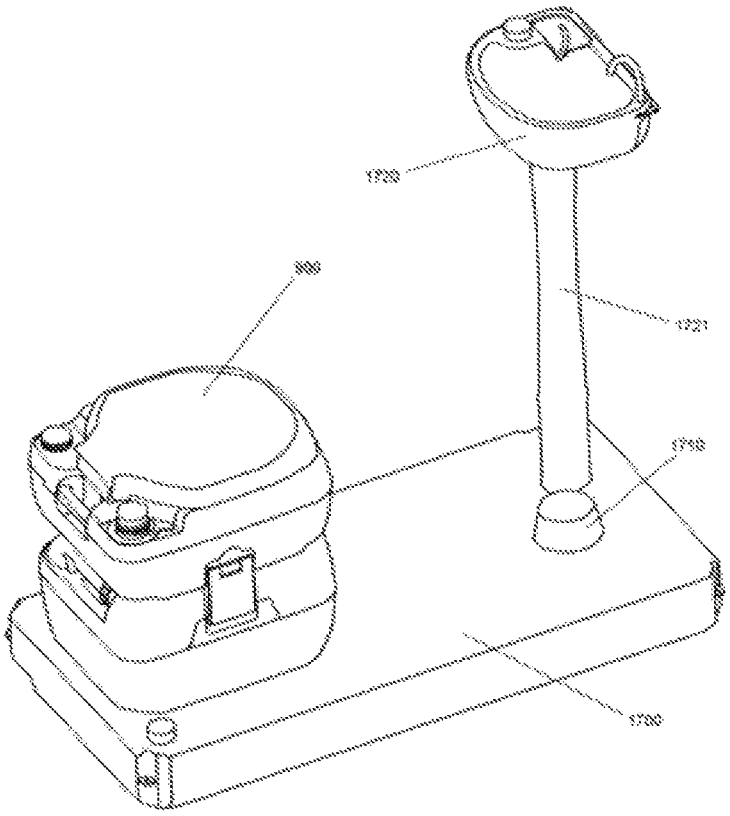
FIG. 33 is a schematic structural diagram of a first form of a standard module according to the present invention.

As shown in FIG. 33, an outer-side ground water tank 1700 in cooperation with washbasin related parts may be provided to serve as a standard module for integration and installation. The outer-side ground water tank 1700 may be directly used as waterproof floor in addition to the use of storing water.

Figure 37:
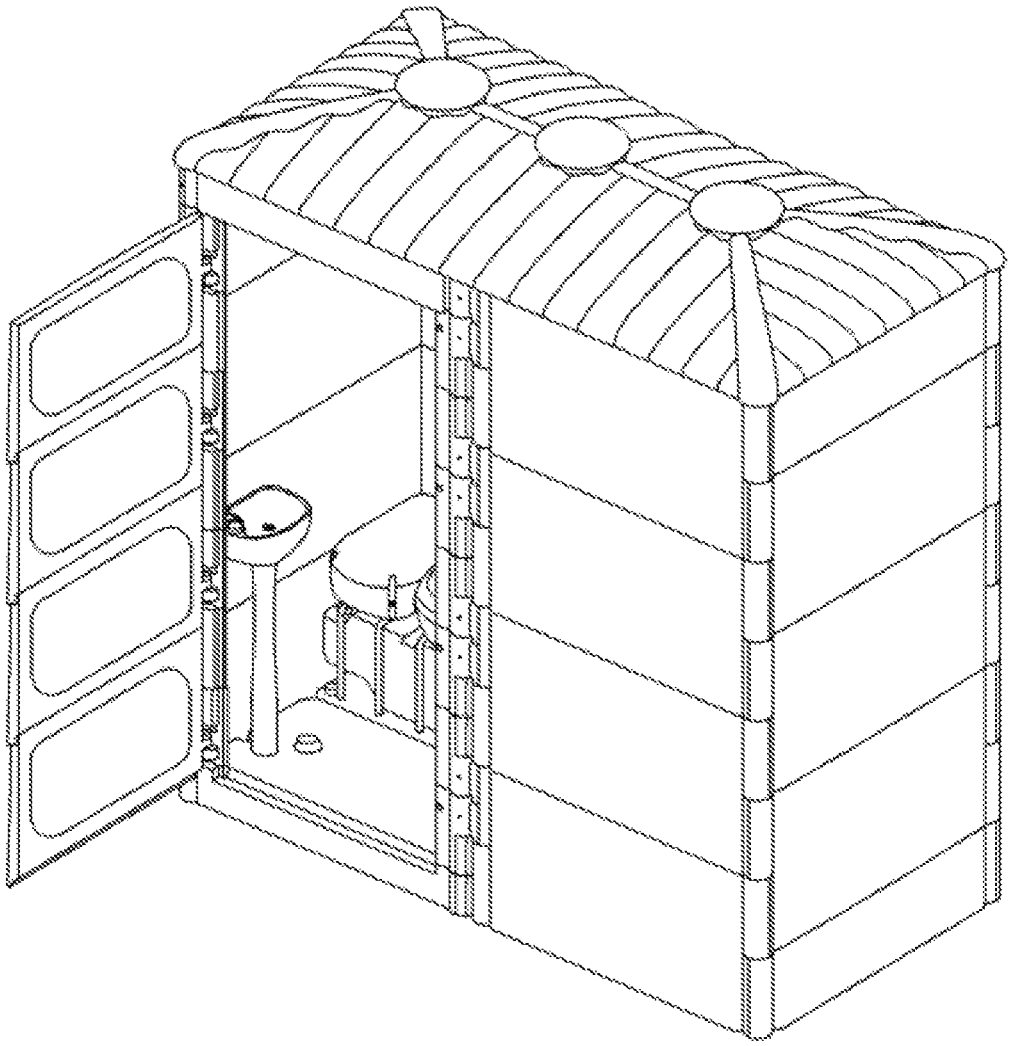
FIG. 37 is a stereoscopic schematic diagram of an extended house-type bathroom having a locker room and a shower room according to the present invention.
Figure 38:
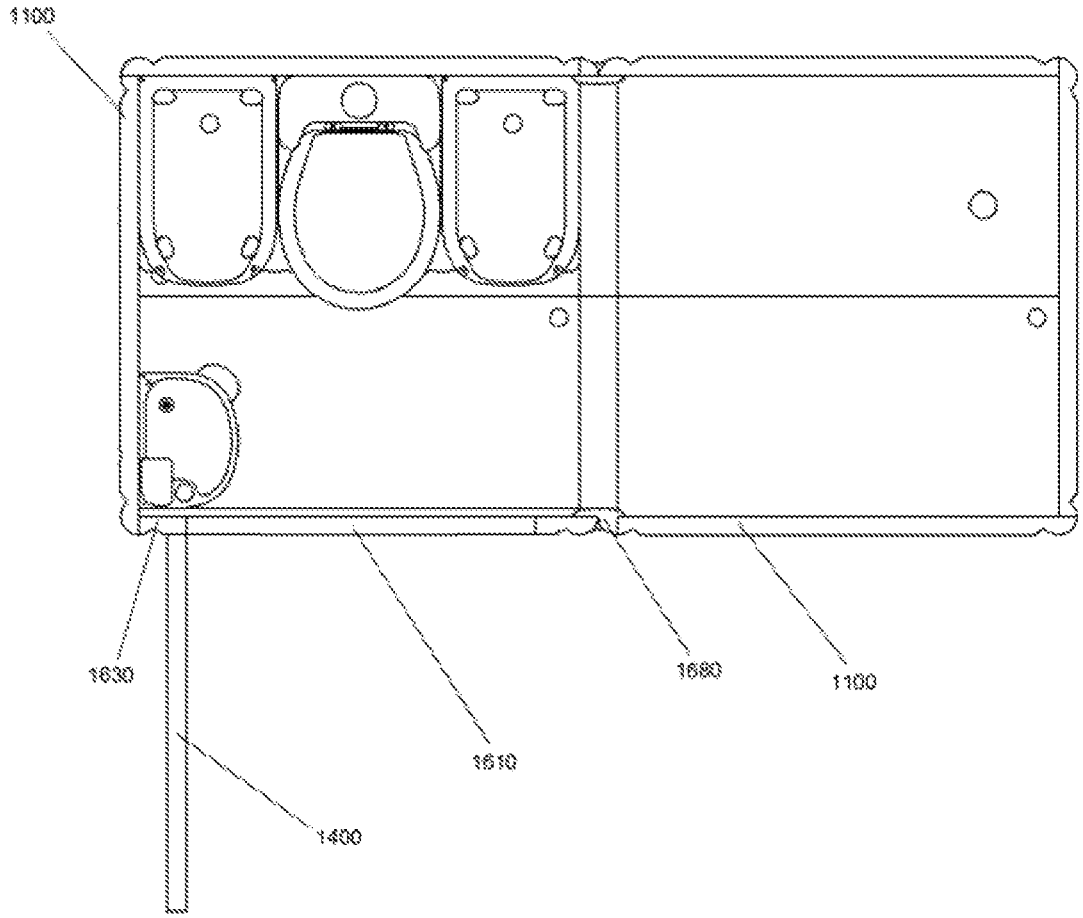
FIG. 38 is a schematic plane view of the extended house-type bathroom having a locker room and a shower room according to the present invention.

As shown in FIG. 37 and FIG. 38, the integral bathroom may further be expanded as an extended house-type bathroom having a locker room and a shower room. Based on the house-type integral bathroom, the house length is extended by using an extension piece 1680, and the integral bathroom is divided by installing a shower curtain by using hooks. Simple shower facilities, shelves, and chairs may be installed in the areas.

The present invention is described above by using examples, but the present invention is not limited to the foregoing specific embodiments. All changes or modification made to the present invention fall within the protection scope of the present invention.

What is claimed is:

1. A component suitable for an assembled container house system, comprising: at least one a first main wallboard (1100), wherein the first main wallboard (1100) has a rectangular body; an upper right portion of the body of the first main wallboard (1100) protrudes rightwards to form a spherical protrusion (1020), and a lower right portion extends rightwards to form an extension portion (1030); an upper left portion of the body of the first main wallboard (1100) extends leftwards to form an extension portion (1030), and a lower left portion protrudes leftwards to form a spherical protrusion (1020); spherical recessed cavities (1010) are formed on front end surfaces of the two extension portions (1030) by means of being recessed backwards; the spherical protrusions (1020) match the spherical recessed cavities (1010); and an axial direction of the spherical protrusion (1020) is perpendicular to an axial direction of the spherical recessed cavity (1010).

2. The component according to claim 1, further comprising a second main wallboard (1200) and a semi-main wallboard (1150), wherein the second main wallboard (1200) has a rectangular body; a lower right portion of the body of the second main wallboard (1200) protrudes rightwards to form a spherical protrusion (1020), and an upper right portion extends rightwards to form an extension portion (1030); a lower left portion of the body of the second main wallboard (1200) extends leftwards to form an extension portion (1030), and an upper left portion protrudes leftwards to form a spherical protrusion (1020); spherical recessed cavities (1010) are formed on front end surfaces of the two extension portions (1030) by means of being recessed backwards; the spherical protrusions (1020) match the spherical recessed cavities (1010); an axial direction of the spherical protrusion (1020) is perpendicular to an axial direction of the spherical recessed cavity (1010); the length of the semi-main wallboard (1150) is equal to the length of the second main wallboard (1200); the height of the first main wallboard (1100) is the same as the height of the second main wallboard (1200); the height of the semi-main wallboard (1150) is a half of the height of the first main wallboard (1100); a right side of the semi-main wallboard (1150) protrudes to form a spherical protrusion (1020)

having an axis parallel to a front end surface of the semi-main wallboard (1150), and a left side protrudes to form an extension portion (1030) having the spherical recessed cavity (1010); and an axis of the spherical recessed cavity (1010) is perpendicular to the front end surface of the semi-main wallboard (1150);

the wallboards are able to connect with each other through the spherical protrusions (1020) matching with the spherical recessed cavities (1010).

3. The component according to claim 2, wherein top portions of the first main wallboard (1100) and the second main wallboard (1200) protrude upwards to form column pins (1060); bottom portions of the first main wallboard (1100) and the second main wallboard (1200) are recessed upwards to form holes matching the column pins (1060); and a top portion of the semi-main wallboard (1150) protrudes upwards to form column pins (1060), and a bottom portion is recessed upwards to form holes matching the column pins (1060).

4. The component according to claim 2, further comprising an auxiliary wallboard (1190), a semi-auxiliary wallboard (1195), and a horizontal connector (1680) capable of butt-jointing wallboards horizontally, wherein the auxiliary wallboard (1190) is the same as the first main wallboard (1100) in shape, and the body length of the auxiliary wallboard (1190) is a half of the body length of the first main wallboard (1100), or the auxiliary wallboard (1190) is the same as the second main wallboard (1200) in shape, and the body length of the auxiliary wallboard (1190) is a half of the body length of the first main wallboard (1100); the height of the auxiliary wallboard (1190) is the same as the height of the first main wallboard (1100) and the height of the second main wallboard (1200); the height of the semi-auxiliary wallboard (1195) is a half of the height of the auxiliary wallboard (1190), and the length of the semi-auxiliary wallboard 1195 is the same as the length of the auxiliary wallboard (1190); and the semi-auxiliary wallboard (1195) is the same as an upper half portion of the auxiliary wallboard (1190) in shape.

5. The component according to claim 4, wherein the horizontal connector (1680) is integrally formed by a first stopper (1684), a second stopper (1681), and a third stopper (1682); the third stopper (1682) is located between the first stopper (1684) and the second stopper (1681); a spherical protrusion (1020) matching the spherical recessed cavity (1010) is formed on the first stopper (1684) in a protruding manner; a spherical recessed cavity (1010) matching the spherical protrusion (1020) is formed on the third stopper (1682) in a recessed manner; an axial direction of the spherical protrusion (1020) on the horizontal connector (1680) is perpendicular to an axial direction of the spherical recessed cavity (1010) on the horizontal connector (1680); and the spherical protrusion (1020) and the spherical recessed cavity (1010) are located on different sides of the third stopper (1682).

6. The component according to claim 3, further comprising a roof, wherein the roof comprises two main roofs (1500) and a daylighting, rainproof, and ventilating skylight (1550); the two main roofs (1500) are able to be assembled with each other; and the daylighting, rainproof, and ventilating skylight (1550) is located between the two main roofs (1500).

7. The component according to claim 6, wherein the roof further comprises at least one auxiliary roof (1580); the auxiliary roof (1580) is assembled between the two main roofs (1500); and the daylighting, rainproof, and ventilating skylight (1550) is assembled between the main roofs (1500) and the auxiliary roof (1580) and between adjacent auxiliary roofs (1580).

8. The component according to claim 3, further comprising: a door plate (1400), a threshold (1610), a door beam (1625), a first corner doorframe (1630), and a second corner doorframe (1640), wherein the door plate (1400) has a rotation portion hingedly connected to a wallboard; the threshold (1610) is recessed; a spherical protrusion (1020) is formed on a right side surface of the threshold (1610) by means of protruding rightwards; a left side of the threshold (1610) protrudes to form a second extension portion of which a rear end surface has a spherical recessed cavity (1010); an axis of the spherical protrusion (1020) on the threshold (1610) is perpendicular to an axis of the spherical recessed cavity (1010) on the threshold (1610); the door beam (1625) is T-shaped; a spherical protrusion (1020) is formed on a left side surface of the door beam (1625) by means of protruding leftwards; a right side of the door beam (1625) protrudes to form a second extension portion of which a rear end surface has a spherical recessed cavity (1010); an axis of the spherical protrusion (1020) on the door beam (1625) is perpendicular to an axis of the spherical recessed cavity (1010) on the door beam (1625); a second extension portion of which a rear end surface has a spherical recessed cavity (1010) is integrally formed on a bottom half portion of a right side of the first corner doorframe (1630); a spherical protrusion (1020) is formed on a top half portion of the right side of the first corner doorframe (1630) by means of protruding rightwards; an axis of the spherical protrusion (1020) on the first corner doorframe (1630) is perpendicular to an axis of the spherical recessed cavity (1010) on the first corner doorframe (1630); a second extension portion of which a rear end surface has a spherical recessed cavity (1010) is integrally formed on a top half portion of a right side of the second corner doorframe (1640); a spherical protrusion (1020) is formed on a bottom half portion of the right side of the second corner doorframe (1640) by means of protruding rightwards; and an axis of the spherical protrusion (1020) on the second corner doorframe (1640) is perpendicular to an axis of the spherical recessed cavity (1010) on the second corner doorframe (1640).

9. The component according to claim 8, further comprising: a roof ridge, wherein the roof ridge is formed by a primary beam, an elastic body (1950), and an integral board (1300) that is installed on two sides of the primary beam in a matching manner; the primary beam is formed by sequentially splicing a plurality of primary beam members (1900) from left to right; a left splicing portion (1903) of the primary beam member (1900) matches a right splicing portion (1904) of the primary beam member (1900); the left splicing portion (1903) and the right splicing portion (1904) are provided with a spherical protrusion (1020) and a spherical recessed cavity (1010) matching each other; an upper end surface of the primary beam member (1900) is provided with a first hook-like structure (1901) and a second hook-like structure (1902) that are distributed in a staggered manner and are opposite to each other; the elastic body (1950) is T-shaped; an inner end of the integral board (1300) is located between the first hook-like structure (1901) and the second hook-like structure (1902) that are opposite to each other and is located between an arm (1951) of the elastic body (1950) and a top surface of the primary beam member (1900).

10. The component according to claim 1, wherein both the spherical recessed cavity (1010) and the spherical protrusion (1020) are integrally formed by means of single-layer and seamless blow molding; and a discontinuous concave-convex structure (1016) is formed on an inner surface of the spherical recessed cavity (1010).

* * * * *